US010570352B2

(12) United States Patent
Holland et al.

(10) Patent No.: US 10,570,352 B2
(45) Date of Patent: Feb. 25, 2020

(54) COLD-WATER LAUNDRY DETERGENTS

(71) Applicant: STEPAN COMPANY, Northfield, IL (US)

(72) Inventors: Brian Holland, Deerfield, IL (US); Randal Bernhardt, Antioch, IL (US); Branko Sajic, Lincolnwood, IL (US)

(73) Assignee: STEPAN COMPANY, Northfield, IL (US)

( * ) Notice: Subject to any disclaimer, the term of this patent is extended or adjusted under 35 U.S.C. 154(b) by 0 days.

(21) Appl. No.: 15/541,500

(22) PCT Filed: Dec. 29, 2015

(86) PCT No.: PCT/US2015/067821
§ 371 (c)(1),
(2) Date: Jul. 5, 2017

(87) PCT Pub. No.: WO2016/111884
PCT Pub. Date: Jul. 14, 2016

(65) Prior Publication Data

US 2017/0369816 A1 Dec. 28, 2017

Related U.S. Application Data

(60) Provisional application No. 62/101,102, filed on Jan. 8, 2015.

(51) Int. Cl.

| | |
|---|---|
| ***C11D 1/37*** | (2006.01) |
| ***C11D 1/14*** | (2006.01) |
| ***C11D 1/29*** | (2006.01) |
| ***C11D 3/386*** | (2006.01) |
| ***C11D 1/22*** | (2006.01) |
| ***C11D 1/90*** | (2006.01) |
| ***C11D 1/34*** | (2006.01) |
| ***C11D 1/83*** | (2006.01) |
| ***C11D 1/92*** | (2006.01) |
| ***C11D 1/62*** | (2006.01) |
| ***C11D 11/00*** | (2006.01) |
| ***C11D 1/72*** | (2006.01) |
| ***C11D 1/75*** | (2006.01) |

(52) U.S. Cl.
CPC ..... *C11D 1/37* (2013.01); *C11D 1/143* (2013.01); *C11D 1/146* (2013.01); *C11D 1/22* (2013.01); *C11D 1/29* (2013.01); *C11D 1/345* (2013.01); *C11D 1/62* (2013.01); *C11D 1/72* (2013.01); *C11D 1/75* (2013.01); *C11D 1/83* (2013.01); *C11D 1/90* (2013.01); *C11D 1/92* (2013.01); *C11D 3/38627* (2013.01); *C11D 11/0017* (2013.01)

(58) Field of Classification Search
CPC ..... C11D 1/37; C11D 17/0039; C11D 1/146; C11D 1/143
See application file for complete search history.

(56) References Cited

U.S. PATENT DOCUMENTS

| | | | |
|---|---|---|---|
| 1,372,034 | A | 3/1921 | Birt |
| 2,247,832 | A | 7/1941 | Burd et al. |
| 2,653,970 | A | 9/1953 | Fessler et al. |
| 3,119,880 | A | 1/1964 | Kollar et al. |
| 3,169,142 | A | 2/1965 | Knaggs et al. |
| 3,332,880 | A | 7/1967 | Adriaan et al. |
| 3,497,555 | A | 2/1970 | Dudzinski et al. |
| 3,544,613 | A | 12/1970 | Knaggs et al. |
| 3,558,716 | A | 1/1971 | Engelhardt et al. |
| 3,664,961 | A | 5/1972 | Norris |
| 3,844,890 | A | 10/1974 | Horikoshi et al. |
| 3,864,407 | A | 2/1975 | Yates |
| 3,887,624 | A | 6/1975 | Gipson et al. |
| 3,929,678 | A | 12/1975 | Laughlin et al. |
| 3,952,068 | A | 4/1976 | Gipson et al. |

(Continued)

FOREIGN PATENT DOCUMENTS

| | | | |
|---|---|---|---|
| CN | 1124497 | A | 6/1996 |
| DE | 2247832 | A1 | 4/1973 |

(Continued)

OTHER PUBLICATIONS

EPO translation of DE19524287, pp. 1-35 1997.*
9-octadecanol MSDS, 1956.*
8-hexadecanol MSDS, 1981.*
Schecter et al., J. Dispersion Sci. Tech. 6 (1985) 223-235.
Evans, J. Chem. Soc. (1956) 579.
Dreger et al., Ind. Eng. Chem. 36 (1944) 610.
Lei et al., J. Chem. Soc., Chem. Commun. (1990) 711.
Finger et al., J. Am. Oil Chem. Soc. 44 (1967) 525.
Granet et al., Colloids Surf. 33 (1988) 321.
Granet et al., Colloids Surf. 49 (1990) 199.
Varadaraj et al., J. Phys. Chem. 95 (1991) 1671.
Varadaraj et al., J. Phys. Chem. 95 (1991) 1677.
Varadaraj et al., J. Phys. Chem. 95 (1991) 1679.
Varadaraj et al., J. Phys. Chem. 95 (1991) 1682.

(Continued)

*Primary Examiner* — Gregory R Delcotto
*Assistant Examiner* — Preeti Kumar
(74) *Attorney, Agent, or Firm* — Dilworth IP, LLC

(57) ABSTRACT

Laundry detergents and their use for cold-water cleaning are disclosed. The detergents comprise a lipase and a mid-chain headgroup surfactant or an alkylene-bridged surfactant. The mid-chain headgroup surfactants have a $C_{14}$-$C_{30}$ alkyl chain and a polar group bonded to a central zone carbon of the $C_{14}$-$C_{30}$ alkyl chain. The alkylene-bridged surfactants comprise a $C_{12}$-$C_{18}$ alkyl chain, a polar group, and a $C_1$-$C_2$ alkylene group bonded to the polar group and a central zone carbon of the $C_{12}$-$C_{18}$ alkyl chain. Surprisingly, when combined with lipases, detergents formulated with the mid-chain headgroup or alkylene-bridged surfactants effectively liquefy greasy soils at low temperature and provide outstanding cold-water performance in removing greasy stains such as bacon grease, butter, cooked beef fat, or beef tallow from soiled articles.

16 Claims, No Drawings

(56) References Cited

U.S. PATENT DOCUMENTS

| | | | | |
|---|---|---|---|---|
| 3,957,664 | A | 5/1976 | Heilman et al. | |
| 3,979,466 | A | 9/1976 | Yates | |
| 4,087,457 | A | 5/1978 | Convers et al. | |
| 4,148,821 | A | 4/1979 | Nussbaum et al. | |
| 4,235,752 | A | 11/1980 | Hampson et al. | |
| 4,275,013 | A | 6/1981 | Tokosh et al. | |
| 4,409,399 | A | 10/1983 | Swift et al. | |
| 4,435,307 | A | 3/1984 | Barbesgaard et al. | |
| 4,507,219 | A | 3/1985 | Hughes | |
| 4,548,744 | A | 10/1985 | Connor | |
| 4,561,998 | A | 12/1985 | Wertz | |
| 4,594,455 | A | 6/1986 | Dudzinski | |
| 4,597,898 | A | 7/1986 | Vander Meer | |
| 4,642,364 | A | 2/1987 | Chan et al. | |
| 4,658,078 | A | 4/1987 | Slaugh et al. | |
| 4,663,071 | A | 5/1987 | Bush et al. | |
| 4,973,788 | A | 11/1990 | Lin et al. | |
| 4,994,622 | A | 2/1991 | Fong et al. | |
| 5,069,810 | A | 12/1991 | Holmes et al. | |
| 5,071,594 | A | 12/1991 | Borland et al. | |
| 5,075,501 | A | 12/1991 | Borland et al. | |
| 5,093,256 | A | 3/1992 | Shen et al. | |
| 5,153,135 | A | 10/1992 | Farin et al. | |
| 5,389,277 | A | 2/1995 | Prieto | |
| 5,403,516 | A * | 4/1995 | Bator | C11D 1/83 510/340 |
| 5,463,101 | A | 10/1995 | Reierson | |
| 5,466,394 | A | 11/1995 | De Buzzaccarini et al. | |
| 5,478,500 | A | 12/1995 | Swift et al. | |
| 5,482,908 | A | 1/1996 | Le-khac | |
| 5,550,274 | A | 8/1996 | Reierson | |
| 5,576,282 | A | 11/1996 | Miracle et al. | |
| 5,614,484 | A | 3/1997 | Panandiker | |
| 5,622,925 | A | 4/1997 | De Buzzaccarini et al. | |
| 5,625,105 | A | 4/1997 | Lin et al. | |
| 5,659,100 | A | 8/1997 | Lin | |
| 5,679,630 | A | 10/1997 | Baeck et al. | |
| 5,696,294 | A | 12/1997 | Abe et al. | |
| 5,703,028 | A * | 12/1997 | Erilli | C11D 1/37 510/236 |
| 5,763,383 | A | 6/1998 | Hashida et al. | |
| 5,929,022 | A | 7/1999 | Velazquez | |
| 6,017,871 | A | 1/2000 | Baeck et al. | |
| 6,017,873 | A | 1/2000 | Sikra et al. | |
| 6,020,303 | A | 2/2000 | Cripe et al. | |
| 6,060,443 | A | 5/2000 | Cripe et al. | |
| 6,083,898 | A * | 7/2000 | Meixner | C08G 73/02 510/499 |
| 6,153,577 | A | 11/2000 | Cripe et al. | |
| 6,156,552 | A | 12/2000 | Okkels et al. | |
| 6,177,012 | B1 | 1/2001 | Lawler et al. | |
| 6,222,077 | B1 | 4/2001 | Singleton | |
| 6,306,812 | B1 | 10/2001 | Perkins et al. | |
| 6,320,080 | B2 | 11/2001 | Connor et al. | |
| 6,326,348 | B1 | 12/2001 | Vinson et al. | |
| 6,566,319 | B1 | 5/2003 | Scheibel et al. | |
| 6,566,408 | B1 | 5/2003 | Cotrell et al. | |
| 6,777,530 | B1 * | 8/2004 | Meixner | C08G 73/02 510/475 |
| 6,878,695 | B2 | 4/2005 | Woo et al. | |
| 6,897,033 | B2 | 5/2005 | Dawson et al. | |
| 6,903,064 | B1 | 6/2005 | Kasturi et al. | |
| 6,949,498 | B2 | 9/2005 | Murphy et al. | |
| 7,018,815 | B2 | 3/2006 | Maekawa et al. | |
| 7,326,675 | B2 | 2/2008 | Schneiderman et al. | |
| 7,396,657 | B2 | 7/2008 | Munk et al. | |
| 7,790,666 | B2 | 9/2010 | Souter et al. | |
| 8,187,854 | B2 | 5/2012 | Wind et al. | |
| 8,334,323 | B2 | 12/2012 | Varineau et al. | |
| 8,691,743 | B2 | 4/2014 | Kellar et al. | |
| 8,859,480 | B2 | 10/2014 | Lant et al. | |
| 2002/0187909 | A1 | 12/2002 | Gupta et al. | |
| 2007/0111924 | A1 | 5/2007 | Ford | |
| 2010/0282467 | A1 | 11/2010 | Hutchison et al. | |
| 2011/0212877 | A1 | 9/2011 | Nielsen et al. | |
| 2017/0066998 | A1 * | 3/2017 | Holland | C11D 1/143 |

FOREIGN PATENT DOCUMENTS

| | | | | |
|---|---|---|---|---|
| DE | 19524287 | A1 * | 1/1997 | C11D 17/0039 |
| EP | 111984 | A1 | 6/1980 | |
| EP | 0075996 | A2 | 4/1983 | |
| EP | 111965 | A2 | 6/1984 | |
| EP | 0112592 | A2 | 7/1984 | |
| EP | 0070077 | B1 | 1/1987 | |
| EP | 0407225 | A1 | 1/1991 | |
| EP | 0215698 | B1 | 10/1991 | |
| EP | 0218272 | B1 | 3/1992 | |
| EP | 0260105 | B1 | 5/1994 | |
| EP | 0305216 | B1 | 8/1995 | |
| EP | 0693549 | A1 | 1/1996 | |
| EP | 0094118 | B2 | 4/1996 | |
| EP | 0331376 | B1 | 10/1997 | |
| EP | 2365054 | A1 | 9/2011 | |
| GB | 1082179 | A | 9/1967 | |
| GB | 1139158 | A | 1/1969 | |
| GB | 1372034 | A | 10/1974 | |
| GB | 2075028 | B | 3/1984 | |
| GB | 2095275 | B | 8/1985 | |
| GB | 2451325 | A | 1/2009 | |
| JP | H08188793 | A | 7/1996 | |
| JP | H08509017 | A | 9/1996 | |
| JP | 2005/298443 | A | 10/2005 | |
| JP | 2009516014 | A | 4/2009 | |
| JP | 2013503964 | A | 2/2013 | |
| JP | 2014064562 | A | 4/2014 | |
| WO | 88/09367 | A1 | 12/1988 | |
| WO | 91/16422 | A1 | 10/1991 | |
| WO | 92/05249 | A1 | 4/1992 | |
| WO | 94/01541 | A1 | 1/1994 | |
| WO | WO-9424242 | A1 * | 10/1994 | C11D 1/146 |
| WO | 94/25578 | A1 | 11/1994 | |
| WO | 95/06720 | A1 | 6/1995 | |
| WO | 95/14783 | A1 | 6/1995 | |
| WO | 95/16016 | A1 | 6/1995 | |
| WO | 95/22615 | A1 | 8/1995 | |
| WO | 9424245 | A1 | 10/1995 | |
| WO | 95/30744 | A1 | 11/1995 | |
| WO | 95/35381 | A1 | 12/1995 | |
| WO | 9533041 | A1 | 12/1995 | |
| WO | 96/00292 | A1 | 1/1996 | |
| WO | 96/12012 | A1 | 4/1996 | |
| WO | 96/13580 | A1 | 5/1996 | |
| WO | 96/27002 | A1 | 9/1996 | |
| WO | 97/04079 | A1 | 2/1997 | |
| WO | 97/07202 | A1 | 2/1997 | |
| WO | 99/05242 | A1 | 2/1999 | |
| WO | 01/14507 | A1 | 3/2001 | |
| WO | 2012/061098 | A1 | 5/2012 | |
| WO | 2013/181083 | A1 | 12/2013 | |
| WO | WO-2015191434 | A2 * | 12/2015 | C11D 1/143 |
| WO | 2016040248 | A2 | 3/2016 | |

OTHER PUBLICATIONS

Bestmann, Angew. Chem., Int. Ed. Engl. 4 (1965) 830, Abstract.
Schaub et al., Tetrahedron Lett. 26 (1985) 307, Abstract.
Frankel, J. Am. Oil. Chem. Soc. 48 (1971) 248, Abstract.
Tracy et al., J. Surf. Det. 5 (2002) 169, Abstract.
Barakat et al., SPEJ 23 (1983), 6, 913.
Brown, H.C., Hydroboration (1962) pp. 12-13 and 114-115.
PCT International Preliminary Report on Patentability dated Dec. 15, 2016, from corresponding Application No. PCT/US2015/034652, 11 pages.
Chemistry & Industry, Issue 8, Apr. 27, 2009, pp. 4-18.
Thirunavukarasu et al., Process Biochemistry, 43 (2008) pp. 701-706.
Xu et al., Advanced Materials Research, vol. 441 (2012) pp. 625-630.
Jurado et al., Industrial & Engineering Chem. Res. (2011), 50 (2) pp. 11502-11510.

(56) References Cited

OTHER PUBLICATIONS

Skagerlind et a., Comun. Present Detergencia (2010) 40, 5 pages.
Chauhan et al., Industrial & Engineering Chem. Res., (2014) 53 (2) pp. 514-520.
Flipsen et al., Enzyme and Microbial Tech., 1998, 23, pp. 274-280.
Obendorf et al., Surfactants, Soaps & Detergents, Jul./Aug. 2002, pp. 51-54.
Obendorf, J. Surf. Deterg. (2001) 4(1), pp. 43-55.
Soleimani et al., J. Surf. Deterg. (2013) 16:421-426.
Sonesson et al., J. Surf. Deterg. (2007) 10:211-218.
Roohi, J. Biochem. Tech. (2013) 4(4):636-644.
Nerurkar et al., J. Surf. Deterg. (2013) 16:435-443.
Mogensen et al., Biochemistry 2005, 44, 1719-7130.
Rubingh et al., Tenside Surf. Det. 35 (1998) 4:254-260.
Rubingh, Curr. Op. (1996) 1 (5) 598-603.
Panaiotov et al., Curr. Op. (1997) 2 (5) 517-525.

* cited by examiner

COLD-WATER LAUNDRY DETERGENTS

FIELD OF THE INVENTION

The invention relates to laundry detergents useful for cold-water cleaning. The detergents comprise a lipase and a mid-chain headgroup surfactant or an alkylene-bridged surfactant.

BACKGROUND OF THE INVENTION

Surfactants are essential components of everyday products such as household and industrial cleaners, agricultural products, personal care products, laundry detergents, oilfield chemicals, specialty foams, and many others.

Modern laundry detergents perform well in removing many kinds of soils from fabrics when warm or hot water is used for the wash cycle. Warmer temperatures soften or melt even greasy soils, which helps the surfactant assist in removing the soil from the fabric. Hot or warm water is not always desirable for washing, however. Warm or hot water tends to fade colors and may accelerate deterioration of the fabric. Moreover, the energy costs of heating water for laundry make cold-water washing more economically desirable and more environmentally sustainable. In many parts of the world, only cold water is available for laundering articles.

Of course, laundry detergents have now been developed that are designed to perform well in hot, warm, or cold water. One popular cold-water detergent utilizes a combination of a nonionic surfactant (a fatty alcohol ethoxylate) and two anionic surfactants (a linear alkylbenzene sulfonate and a fatty alcohol ethoxylate sulfate) among other conventional components. Commercially available cold-water detergents tend to perform well on many common kinds of stains, but they have difficulty removing greasy dirt, particularly bacon grease, beef tallow, butter, cooked beef fat, and the like. These soils are often deposited as liquids but quickly solidify and adhere tenaciously to textile fibers. Particularly in a cold-water wash cycle, the surfactant is often overmatched in the challenge to wet, liquefy, and remove these greasy, hardened soils.

Most surfactants used in laundry detergents have a polar head and a nonpolar tail. The polar group (sulfate, sulfonate, amine oxide, etc.) is usually located at one end of the chain. Branching is sometimes introduced to improve the solubility of the surfactant in cold water, especially for surfactants with higher chain lengths ($C_{14}$ to $C_{30}$), although there is little evidence that branching improves cold-water cleaning performance. Moreover, even the branched surfactants keep the polar group at or near the chain terminus (see, e.g., U.S. Pat. Nos. 6,020,303; 6,060,443; 6,153,577; and 6,320,080).

Secondary alkyl sulfate (SAS) surfactants are well known and have been used in laundry detergents. Typically, these materials have sulfate groups that are randomly distributed along the hydrocarbyl backbone. In some cases, the random structure results from addition of sulfuric acid across the carbon-carbon double bond in internal olefin mixtures, accompanied by double bond isomerization under the highly acidic conditions. Commercially available SAS from Clariant under the Hostaspur® mark is made using the Hoechst light/water process in which n-paraffins are reacted with sulfur dioxide and oxygen in the presence of water and UV light, followed by neutralization, to produce secondary alkyl monosulfonates as the principal product.

Secondary alkyl sulfates have been produced in which the sulfate group resides at the 2- or 3-position of the alkyl chain (see, e.g., PCT Internat. Appl. WO 95/16016, EP 0693549, and U.S. Pat. Nos. 5,478,500 and 6,017,873). These are used to produce agglomerated high-density detergent compositions that include linear alkylbenzene sulfonates, fatty alcohol sulfates, and fatty alcohol ether sulfates. Similarly, U.S. Pat. No. 5,389,277 describes secondary alkyl sulfate-containing powdered laundry detergents in which the alkyl chain is preferably $C_{12}$-$C_{18}$ and the sulfate group is preferably at the 2-position.

Longer-chain ($C_{14}$-$C_{30}$) surfactants have been produced in which the polar group resides at a central carbon on the chain, but such compositions have not been evaluated for use in cold-water laundry detergents. For example, U.S. Pat. No. 8,334,323 teaches alkylene oxide-capped secondary alcohol alkoxylates as surfactants. In a few examples, the original —OH group from the alcohol is located on a central carbon of the alkyl chain, notably 8-hexadecanol and 6-tetradecanol. As another example, sodium 9-octadecyl sulfonate has been synthesized and taught as a surfactant for use in enhanced oil recovery (see *J. Disp. Sci. Tech.* 6 (1985) 223 and *SPEJ* 23 (1983) 913). Sodium 8-hexadecyl sulfonate has been reported for use in powder dishwashing detergents (see, e.g., JP 0215698).

Numerous investigators have studied a series of secondary alcohol sulfates in which the position of the sulfate group is systematically moved along the alkyl chain to understand its impact on various surfactant properties. For example, Evans (*J. Chem. Soc.* (1956) 579) prepared a series of secondary alcohol sulfates, including sodium sulfates of 7-tridecanol, 8-pentadecanol, 8-hexadecanol, 9-septadecanol, 10-nonadecanol and 15-nonacosanol (C29), and measured critical micelle concentrations and other properties. More recently, Xue-Gong Lei et al. (*J. Chem. Soc., Chem. Commun.* (1990) 711) evaluated long-chain (C21+) alcohol sulfates with mid-chain branching as part of a membrane modeling study.

Dreger et al. (*Ind. Eng. Chem.* 36 (1944) 610) prepared secondary alcohol sulfates having 11 to 19 carbons. Some of these were "sym-sec-alcohol sulfates" in which the sulfate group was bonded to a central carbon (e.g., sodium 7-tridecyl sulfate or sodium 8-pentadecyl sulfate). Detergency of these compositions was evaluated in warm (43° C.) water. The authors concluded that "when other factors are the same, the nearer the polar group is to the end of a straight-chain alcohol sulfate, the better the detergency." Cold-water performance was not evaluated.

Similarly, Finger et al. (*J. Am. Oil Chem. Soc.* 44 (1967) 525) studied the effect of alcohol structure and molecular weight on properties of the corresponding sulfates and ethoxyate sulfates. The authors included sodium 7-tridecyl sulfate and sodium 7-pentadecyl sulfate in their study. They concluded that moving the polar group away from the terminal position generally decreases cotton detergency and foam performance.

Surfactants in which the polar group is separated from the principal alkyl chain by an alkylene bridge are known. Some methylene-bridged surfactants of this type are derived from "Guerbet" alcohols. Guerbet alcohols can be made by dimerizing linear or branched aliphatic alcohols using a basic catalyst using chemistry first discovered in the 19th century. The alcohols, which have a —$CH_2$— bridge to the hydroxyl group near the center of the alkyl chain, can be converted to alkoxylates, sulfates, and ether sulfates (see, e.g., Varadaraj et al., *J. Phys. Chem.* 95 (1991), 1671, 1677, 1679, and 1682). The Guerbet derivatives have not apparently been shown to have any particular advantage for cold-water cleaning.

Surprisingly few references describe surfactants that demonstrate improved cleaning using cold water (i.e., less than 30° C.). U.S. Pat. No. 6,222,077 teaches dimerized alcohol compositions and biodegradable surfactants made from them having cold water detergency. A few examples are provided to show improved cold water detergencies on an oily (multisebum) soil when compared with a sulfated Neodol® $C_{14}$-$C_{15}$ alcohol. Made by dimerizing internal or alpha olefins (preferably internal olefins) in multiple stages followed by hydroformylation, these surfactants are difficult to characterize. As shown in Examples 1-3 of Table 1 of the '077 patent, NMR characterization shows that a single dimerized alcohol product typically has multiple components and a wide distribution of branch types (methyl, ethyl, propyl, butyl, and higher) and various attachment points on the chain for the branches. A high degree of methyl branching (14-20%) and ethyl branching (13-16%) is also evident.

PCT Internat. Appl. No. WO 01/14507 describes laundry detergents that combine a $C_{16}$ Guerbet alcohol sulfate and an alcohol ethoxylate. Compared with similar fully formulated detergents that utilize a linear $C_{16}$ alcohol sulfate, the detergent containing the Guerbet alcohol sulfate provides better cleaning in hot (60° C.) or warm (40° C.) water. Laundering with cold (<30° C.) water is not disclosed or suggested.

PCT Internat. Appl. No. WO 2013/181083 teaches laundry detergent compositions made by dimerizing even-numbered alpha-olefins to produce vinylidenes, hydroformylation of the vinylidenes to give alcohols mixtures, and sulfation of the alcohols. Hydroformylation is performed in a manner effective to provide alcohol mixtures in which methyl-branched products predominate. According to the applicants, methyl branching on even-numbered carbons on the alkyl chain is believed to contribute to rapid biodegradation in sulfate surfactants made from the alcohols. When compared with similar sulfates having random branching on the chain, those with branching on even-numbered carbons had similar cleaning ability at 20° C. but improved biodegradability.

Enzymes, including lipases, are well-known for use in laundry detergents. Lipases are believed to be effective for removal of greasy soils because the enzymes target breakdown of lipids, such as fats and oils. Although cleaning performance can sometimes be improved with lipases, it remains unpredictable what combinations of lipases and conventional surfactants will provide a synergistic improvement in cleaning performance, particularly when cold water laundering is used.

Improved detergents are always in need, especially laundry detergents that perform well in cold water. Of particular interest are detergents that can tackle greasy dirt such as bacon grease or beef tallow, because these stains solidify and adhere strongly to common textile fibers. Ideally, the kind of cleaning performance on greasy dirt that consumers are used to enjoying when using hot water could be realized even with cold water.

SUMMARY OF THE INVENTION

In one aspect, the invention relates to a laundry detergent that is useful for cold-water cleaning. The detergent comprises a lipase and a mid-chain headgroup surfactant or an alkylene-bridged surfactant.

The mid-chain headgroup surfactant has a saturated or unsaturated, linear or branched $C_{14}$-$C_{30}$ alkyl chain. In addition, the mid-chain headgroup surfactant has a polar group (or "headgroup") bonded to a central zone carbon of the $C_{14}$-$C_{30}$ alkyl chain. In some aspects, the mid-chain headgroup surfactants are alcohol sulfates, alcohol ethoxylates, ether sulfates, sulfonates, aryl sulfonates, alcohol phosphates, amine oxides, quaterniums, betaines, and sulfobetaines.

The alkylene-bridged surfactant comprises a saturated or unsaturated, linear or branched $C_{12}$-$C_{18}$ alkyl chain, a polar group, and a $C_1$-$C_2$ alkylene group bonded to the polar group and a central zone carbon of the $C_{12}$-$C_{18}$ alkyl chain. The alkylene-bridged surfactant has, excluding the polar group, a total of 14 to 19 carbons. In some aspects, the alkylene-bridged surfactants are alcohol sulfates, alcohol alkoxylates, ether sulfates, sulfonates, aryl sulfonates, alcohol phosphates, amine oxides, quaterniums, betaines, and sulfobetaines.

In addition to either a mid-chain headgroup surfactant or an alkylene-bridged surfactant, the detergents comprise a lipase. Suitable lipases have animal, plant, fungal, or microbiological origin and may be naturally occurring or man-made variants.

We surprisingly found that when combined with a lipase, detergents formulated with the mid-chain headgroup surfactants or alkylene-bridged surfactants effectively liquefy greasy soils at low temperature and provide outstanding cold-water performance in removing greasy stains such as bacon grease, butter, cooked beef fat, or beef tallow from soiled articles.

DETAILED DESCRIPTION OF THE INVENTION

In one aspect, the invention relates to lipase-containing detergents useful for cold-water cleaning. Some of the detergents comprise a "mid-chain headgroup" surfactant while others comprise an "alkylene-bridged" surfactant. These two surfactant types are described in more detail below.

Lipases

We surprisingly found that cleaning performance on greasy soils is synergistically improved by using a lipase in combination with either a mid-chain headgroup surfactant or an alkylene-bridged surfactant (as described hereinbelow).

Lipases are enzymes that catalyze hydrolysis of fats and oils to fatty acids and glycerol, monoglycerides, and/or diglycerides. Suitable lipases for use herein include those of animal, plant, fungal, and microbiological origin. Suitable lipase enzymes can be found in cambium, bark, plant roots, and in the seeds of fruit, oil palm, lettuce, rice, bran, barley and malt, wheat, oats and oat flour, cotton tung kernels, corn, millet, coconuts, walnuts, fusarium, cannabis and cucurbit. In addition to naturally occurring lipases, chemically modified or protein engineered mutants can be used.

Suitable lipases include lipases from microorganisms of the *Humicola* group (also called *Thermomyces*), e.g., from *H. lanuginosa* (*T. lanuginosus*) as described, e.g., in EP 258 068 and EP 305 216, or from *H. insolens* (see, e.g., PCT Internat. Appl. WO 96/13580); *Pseudomonas lipases*, e.g., from *P. alcaligenes* or *P. pseudoalcaligenes* (see, e.g., EP 218 272), *P. cepacia* (see, e.g., EP 331 376), *P. stutzeri* (see, e.g., British Pat. No. 1,372,034), *P. fluorescens, Pseudomonas* sp. strain SD 705 (see, e.g., PCT Internat. Appls. WO 95/06720 and WO 96/27002), or *P. wisconsinensis* (see, e.g., PCT Internat. Appl. WO 96/12012); or *Bacillus lipases*, e.g., from *B. subtilis, B. stearothermophilus* or *B. pumilus* (see, e.g., PCT Internat. Appl. WO 91/16422).

Lipase variants can be used, such as those described in U.S. Pat. Nos. 8,187,854; 7,396,657; and 6,156,552, the teachings of which are incorporated herein by reference.

Additional lipase variants are described in PCT Internat. Appls. WO 92/05249, WO 94/01541, WO 95/35381, WO 96/00292, WO 95/30744, WO 94/25578, WO 95/14783, WO 95/22615, WO 97/04079 and WO 97/07202, and in EP 0 407 225 and EP 0 260 105.

Suitable lipases include those sold under the tradenames Lipex™, Lipolex™, Lipoclean™, Lipolase™, Lipolase Ultra™, Lipopan™, Lipopan Xtra™, Lypozyme™, Palatase™, Resinase™, Novozym™ 435, and Lipoprime™ (all from Novozymes). Other suitable lipases are available as Lipase P Amano™ (Amano Pharmaceutical). Further suitable lipases are lipases such as M1 Lipase™ and Lipomax™ (DSM) and Lumafast™ (Danisco). Preferred lipases include the D96L lipolytic enzyme variant of the native lipase derived from *Humicola lanuginosa* as described in U.S. Pat. No. 6,017,871. Preferably, the *Humicola lanuginosa* strain DSM 4106 is used.

The lipase can be used at any suitable level. Generally, the lipase is present in the inventive detergents in an amount of 10 to 20000 LU/g of the detergent, or even 100 to 10000 LU/g. The LU unit for lipase activity is defined in WO99/42566. The lipase dosage in the wash solution is typically from 0.01 to 5 mg/L active lipase protein, more typically 0.1 to 2 mg/L. As a weight percentage, the lipase can be used in the detergent at 0.00001 to 2 wt. %, usually 0.0001 to 1 wt. %, or even 0.001 to 0.5 wt. %.

The lipase may be incorporated into the detergent in any convenient form, e.g., non-dusting granules, stabilized liquids, or protected (e.g., coated) particles.

For more examples of suitable lipases useful herein, see U.S. Pat. Nos. 5,069,810; 5,093,256; 5,153,135; 5,614,484; 5,763,383; 6,177,012; 6,897,033; 7,790,666; 8,691,743; and 8,859,480, and U.S. Pat. Appl. Publ. No. 2011/0212877, the teachings of which are incorporated herein by reference.

Mid-Chain Headgroup Surfactant

"Mid-chain headgroup" surfactant means a surfactant in which the polar group is located at or near the center of the longest continuous alkyl chain. The mid-chain headgroup surfactant has a saturated or unsaturated, linear or branched $C_{14}$-$C_{30}$ alkyl chain and a polar group bonded to a central zone carbon of the $C_{14}$-$C_{30}$ alkyl chain.

The "central carbon" of the $C_{14}$-$C_{30}$ alkyl chain is identified by: (1) finding the longest continuous alkyl chain; (2) counting the number of carbons in that chain; (3) dividing the number of carbons in the longest chain by 2. When the longest continuous carbon chain has an even number of carbons, the central carbon is found by counting from either chain end the result in (3). In this case, there will be two possible attachment sites. When the longest continuous carbon chain has an odd number of carbons, the result in (3) is rounded up to the next highest integer value, and the central carbon is found by counting from either chain end that rounded-up result. There will be only one possible attachment site.

For example, consider sodium 9-octadecyl sulfate. The longest continuous carbon chain has 18 carbons. Dividing 18 by 2 gives 9. Counting 9 carbons from either end and attaching the polar group gives the same result from either end because of the lack of any branching in the $C_{18}$ chain.

As another example, consider sodium 2-methyl-8-pentadecyl sulfate. The longest continuous carbon chain has 15 carbons. Dividing 15 by 2 gives 7.5. We round 7.5 up to 8, then count 8 carbons from either end and attach the polar group.

By "central zone carbon," we mean a "central carbon" as defined above, or a carbon in close proximity to the central carbon. When the longest continuous alkyl chain has an even number of carbons, the two central carbons and any carbon in the α- or β-position with respect to either central carbon are within the "central zone." When the longest continuous alkyl chain has an odd number of carbons, the central carbon and any carbon in the α-, β-, or γ-position with respect to the central carbon are within the "central zone."

Another way to identify the central zone carbons is as follows. Let N=the number of carbons in the longest continuous alkyl chain. N has a value from 14 to 30. When N is even, the central zone carbons are found by counting N/2, (N/2)−1, or (N/2)−2 carbons from either end of the chain. When N is odd, the central zone carbons are found by counting (N+1)/2, [(N+1)/2]−1, [(N+1)/2]−2, or [(N+1)/2]−3 carbons from either end of the chain.

For example, when N=25, the central zone carbons will be found by counting 13, 12, 11, or 10 carbons from either end of the chain. When N=18, the central zone carbons will be found by counting 9, 8, or 7 carbons from either end of the chain.

Based on the above considerations, detergents considered to be within the invention will comprise a mid-chain headgroup surfactant having one or more of the following configurations: 14-7, 14-6, 14-5, 15-8, 15-7, 15-6, 15-5, 16-8, 16-7, 16-6, 17-9, 17-8, 17-7, 17-6, 18-9, 18-8, 18-7, 19-10, 19-9, 19-8, 19-7, 20-10, 20-9, 20-8, 21-11, 21-10, 21-9, 21-8, 22-11, 22-10, 22-9, 23-12, 23-11, 23-10, 23-9, 24-12, 24-11, 24-10, 25-13, 25-12, 25-11, 25-10, 26-13, 26-12, 26-11, 27-14, 27-13, 27-12, 27-11, 28-14, 28-13, 28-12, 29-15, 29-14, 29-13, 29-12, 30-15, 30-14, and 30-13 where the first number is N, the number of carbons in the longest continuous alkyl chain, and the second number is the location of the polar group in terms of the number of carbons away from one end of the alkyl chain.

The mid-chain headgroup surfactant has a saturated or unsaturated, linear or branched $C_{14}$-$C_{30}$ alkyl chain, preferably a $C_{14}$-$C_{20}$ alkyl chain, even more preferably a $C_{14}$-$C_{18}$ alkyl chain.

In mid-chain headgroup surfactants for which the longest continuous alkyl chain has an even number of carbons, the polar group is preferably attached to one of the two central carbons or a carbon in the α-position with respect to either central carbon. More preferably, the polar group is attached to one of the two central carbons.

In mid-chain headgroup surfactants for which the longest continuous alkyl chain has an odd number of carbons, the polar group is preferably attached to the central carbon or a carbon in the α- or β-position with respect to the central carbon. More preferably, the polar group is attached to the central carbon or a carbon in the α-position with respect to the central carbon. Most preferably, the polar group is attached to the central carbon.

A variety of polar groups are considered suitable for use, as the location on the chain appears to be more important than the nature of the polar group. Thus, suitable mid-chain headgroup surfactants include alcohol sulfates, alcohol ethoxylates, ether sulfates, sulfonates, aryl sulfonates, alcohol phosphates, amine oxides, quaterniums, betaines, sulfobetaines, and the like, and their mixtures. Alcohol sulfates, ether sulfates, and sulfonates are particularly preferred mid-chain headgroup surfactants.

The alcohol sulfates are conveniently made by reacting the corresponding alcohol with a sulfating agent according to known methods (see, e.g., U.S. Pat. No. 3,544,613, the teachings of which are incorporated herein by reference). Sulfamic acid is a convenient reagent that sulfates the hydroxyl group without disturbing any unsaturation present in the alkyl chain. Thus, warming the alcohol with sulfamic acid optionally in the presence of urea or another proton acceptor conveniently provides the desired alkyl ammonium sulfate. The ammonium sulfate is easily converted to an alkali metal sulfate by reaction with an alkali metal hydroxide (e.g., sodium hydroxide) or other ion-exchange reagents (see preparation of sodium 9-octadecyl sulfate, below). Other suitable sulfating agents include sulfur trioxide, oleum, and chlorosulfonic acid may be used.

The alcohol precursors to the sulfates can be purchased or synthesized. When the mid-chain alcohol is not commercially available, it usually can be prepared from an aldehyde, an alkyl halide, and magnesium using a conventional Grignard reaction. Other methods exist, including forming an internal olefin via metathesis, followed by reaction of the internal olefin under cold conditions with sulfuric acid, followed by either cold neutralization of the resulting sulfate, or hydrolysis of the sulfate ester with warm water.

When an alcohol ethoxylate is desired, the alcohol precursor is reacted with ethylene oxide, usually in the presence of a base, to add a desired average number of oxyethylene units. Typically, the number of oxyethylene units ranges from 0.5 to 100, preferably from 1 to 30, more preferably from 1 to 10.

When an ether sulfate is desired, the alcohol precursor is first alkoxylated by reacting it with ethylene oxide, propylene oxide, or a combination thereof to produce an alkoxylate. Alkoxylations are usually catalyzed by a base (e.g., KOH), but other catalysts such as double metal cyanide complexes (see, e.g., U.S. Pat. No. 5,482,908) can also be used. The oxyalkylene units can be incorporated randomly or in blocks. Sulfation of the alcohol alkoxylate (usually an alcohol ethoxylate) gives the desired ether sulfate.

Suitable fatty alcohol precursors to the mid-chain sulfates or ether sulfates include, for example, 7-tetradecanol, 6-tetradecanol, 5-tetradecanol, 8-pentadecanol, 7-pentadecanol, 6-pentadecanol, 5-pentadecanol, 8-hexadecanol, 7-hexadecanol, 6-hexadecanol, 9-septadecanol, 8-septadecanol, 7-septadecanol, 6-septadecanol, 9-octadecanol, 8-octadecanol, 7-octadecanol, 10-nonadecanol, 9-nonadecanol, 8-nonadecanol, 7-nonadecanol, 10-eicosanol, 9-eicosanol, 8-eicosanol, 11-heneicosanol, 10-heneicosanol, 9-heneicosanol, 8-heneicosanol, 11-docosanol, 10-docosanol, 9-dococanol, 12-tricosanol, 11-tricosanol, 10-tricosanol, 9-tricosanol, 12-tetracosanol, 11-tetracosanol, 10-tetracosanol, 9-tetracosanol, 13-pentacosanol, 12-pentacosanol, 11-pentacosanol, 10-pentacosanol, 13-hexacosanol, 12-hexacosanol, 11-hexacosanol, 14-heptacosanol, 13-heptacosanol, 12-heptacosanol, 11-heptacosanol, 14-octacosanol, 13-octacosanol, 12-octacosanol, 15-nonacosanol, 14-nonacosanol, 13-nonacosanol, 12-nonacosanol, 15-triacontanol, 14-triacontanol, 13-triacontanol, and the like, and mixtures thereof. 9-Octadecanol and 8-hexadecanol are particularly preferred.

Mid-chain sulfonates can be made by reacting an internal olefin with a sulfonating agent. Sulfonation is performed using well-known methods, including reacting the olefin with sulfur trioxide, chlorosulfonic acid, fuming sulfuric acid, or other known sulfonating agents. Chlorosulfonic acid is a preferred sulfonating agent. The sultones that are the immediate products of reacting olefins with $SO_3$, chlorosulfonic acid, and the like may be subsequently subjected to hydrolysis and neutralization with aqueous caustic to afford mixtures of alkene sulfonates and hydroxyalkane sulfonates. Suitable methods for sulfonating olefins are described in U.S. Pat. Nos. 3,169,142; 4,148,821; and U.S. Pat. Appl. Publ. No. 2010/0282467, the teachings of which are incorporated herein by reference.

Suitable mid-chain sulfonates can be made by sulfonating internal olefins.

Preferred internal olefins include, for example, 7-tetradecene, 6-tetradecene, 5-tetradecene, 8-pentadecene, 7-pentadecene, 6-pentadecene, 5-pentadecene, 8-hexadecene, 7-hexadecene, 6-hexadecene, 9-septadecene, 8-septadecene, 7-septadecene, 6-septadecene, 9-octadecene, 8-octadecene, 7-octadecene, 10-nonadecene, 9-nonadecene, 8-nonadecene, 7-nonadecene, 10-eicosene, 9-eicosene, 8-eicosene, 11-heneicosene, 10-heneicosene, 9-heneicosene, 8-heneicosene, 11-docosene, 10-docosene, 9-docosene, 12-tricosene, 11-tricosene, 10-tricosene, 9-tricosene, 12-tetracosene, 11-tetracosene, 10-tetracosene, 13-pentacosene, 12-pentacosene, 11-pentacosene, 10-pentacosene, 13-hexacosene, 12-hexacosene, 11-hexacosene, 14-heptacosene, 13-heptacosene, 12-heptacosene, 11-heptacosene, 14-octacosene, 13-octacosene, 12-octacosene, 15-nonacosene, 14-nonacosene, 13-nonacosene, 12-nonacosene, 15-triacontene, 14-triacontene, 13-triacontene, and mixtures thereof.

Internal olefin precursors to the mid-chain sulfonates can be prepared by olefin metathesis (and subsequent fractionation), alcohol dehydration, pyrolysis, elimination reactions, the Wittig reaction (see, e.g., *Angew. Chem., Int. Ed. Engl.* 4 (1965) 830; *Tetrahedron Lett.* 26 (1985) 307; and U.S. Pat. No. 4,642,364), and other synthetic methods known to those skilled in the art. For more examples of suitable methods, see I. Harrison and S. Harrison, *Compendium of Organic Synthetic Methods*, Vol. I (1971) (Wiley) and references cited therein.

Mid-chain arylsulfonates can be made by alkylating arenes such as benzene, toluene, xylenes, or the like, with internal olefins, followed by sulfonation of the aromatic ring and neutralization.

The alcohol precursors to mid-chain headgroup surfactants mentioned above can be converted to the corresponding amines by an amination process. In some cases, it may be more desirable to make the amines through an intermediate such as a halide or other compound having a good leaving group.

The mid-chain amine oxides and quaterniums are conveniently available from the corresponding tertiary amines by oxidation or quaternization. The mid-chain betaines and sulfobetaines are conveniently available from the corresponding primary amines by reaction with, e.g., sodium monochloroacetate (betaines) or sodium metabisulfite and epichlorohydrin in the presence of base (sulfobetaines). For examples of how to prepare quaterniums, betaines, and sulfobetaines, see PCT Int. Publ. No. WO2012/061098, the teachings of which are incorporated herein by reference.

Alkylene-Bridged Surfactant

In some aspects, the detergents comprise an "alkylene-bridged" surfactant. This surfactant has (a) a saturated or unsaturated, linear or branched $C_{12}$-$C_{18}$ alkyl chain; (b) a polar group; and (c) a $C_1$-$C_2$ alkylene group bonded to the polar group and a central zone carbon of the $C_{12}$-$C_{18}$ alkyl chain. Excluding the polar group, the surfactant has a total of 14 to 19 carbons, preferably 15 to 19 carbons, more preferably 16 to 18 carbons.

"Alkylene-bridged" surfactant" means a surfactant in which the polar group is bonded to a $C_1$-$C_2$ alkylene bridge, and this bridge is bonded to a carbon located at or near the center of the longest continuous alkyl chain, excluding the $C_1$-$C_2$ alkylene group.

The "central carbon" of the $C_{12}$-$C_{18}$ alkyl chain is identified by: (1) finding the longest continuous alkyl chain excluding the $C_1$-$C_2$ alkylene group; (2) counting the number of carbons in that chain; (3) dividing the number of carbons in that longest chain by 2. When the longest continuous carbon chain (excluding the $C_1$-$C_2$ alkylene group) has an even number of carbons, the central carbon is found by counting from either chain end the result in (3). In this case, there will be two possible attachment sites for the alkylene bridge. When the longest continuous carbon chain (excluding the $C_1$-$C_2$ alkylene group) has an odd number of carbons, the result in (3) is rounded up to the next highest integer value, and the central carbon is found by counting from either chain end that rounded-up result. There will be only one possible attachment site.

For example, consider sodium 2-hexyl-1-undecyl sulfate. The longest continuous carbon chain (excluding the —$CH_2$— bridge) has 16 carbons. Dividing 16 by 2 gives 8. We count 8 carbons from either end to locate either of two central carbons.

As another example, consider sodium 2-octyl-1-decyl sulfate. The longest continuous carbon chain (excluding the —$CH_2$— bridge) has 17 carbons. Dividing 17 by 2 gives 8.5. We round up 8.5 to 9. Counting 9 carbons from either end provides the location of the lone central carbon.

By "central zone carbon," we mean a "central carbon" as defined above, or a carbon in close proximity to the central carbon. When the longest continuous alkyl chain (excluding the $C_1$-$C_2$ alkylene group) has an even number of carbons, the two central carbons and any carbon in the α- or β-position with respect to either central carbon are within the "central zone." When the longest continuous alkyl chain (excluding the $C_1$-$C_2$ alkylene group) has an odd number of carbons, the central carbon and any carbon in the α-, β-, or γ-position with respect to the central carbon are within the "central zone."

Another way to identify the central zone carbons is as follows. Let N=the number of carbons in the longest continuous alkyl chain (excluding the $C_1$-$C_2$ alkylene group). N has a value from 12 to 18. When N is even, the central zone carbons are found by counting N/2, (N/2)−1, or (N/2)−2 carbons from either end of the chain. When N is odd, the central zone carbons are found by counting (N+1)/2, [(N+1)/2]−1, [(N+1)/2]−2, or [(N+1)/2]−3 carbons from either end of the chain.

For example, when N=15, the central zone carbons will be found by counting 8, 7, 6, or 5 carbons from either end of the chain. When N=18, the central zone carbons will be found by counting 9, 8, or 7 carbons from either end of the chain.

Based on the above considerations, detergents considered to be within the invention will comprise an alkylene-bridged surfactant having one or more of the following configurations: 12-6, 12-5, 12-4, 13-7, 13-6, 13-5, 13-4, 14-7, 14-6, 14-5, 15-8, 15-7, 15-6, 15-5, 16-8, 16-7, 16-6, 17-9, 17-8, 17-7, 17-6, 18-9, 18-8, and 18-7, where the first number is N, the number of carbons in the longest continuous alkyl chain (excluding the $C_1$-$C_2$ alkylene group), and the second number is the location of the alkylene-bridged polar group in terms of the number of carbons away from one end of the alkyl chain.

In alkylene-bridged surfactants for which the longest continuous alkyl chain (excluding the $C_1$-$C_2$ alkylene group) has an even number of carbons, the alkylene bridge is preferably attached to one of the two central carbons or a carbon in the α-position with respect to either central carbon. More preferably, the alkylene bridge is attached to one of the two central carbons.

In alkylene-bridged surfactants for which the longest continuous alkyl chain (excluding the $C_1$-$C_2$ alkylene group) has an odd number of carbons, the alkylene bridge is preferably attached to the central carbon or a carbon in the α- or β-position with respect to the central carbon. More preferably, the alkylene bridge is attached to the central carbon or a carbon in the α-position with respect to the central carbon. Most preferably, the alkylene bridge is attached to the central carbon.

A variety of polar groups are considered suitable for use, as the location on the chain appears to be more important than the nature of the polar group. Thus, suitable alkylene-bridged surfactants include alcohol sulfates, alcohol alkoxylates, ether sulfates, sulfonates, aryl sulfonates, alcohol phosphates, amine oxides, quaterniums, betaines, sulfobetaines, and the like, and their mixtures. Alcohol sulfates, ether sulfates, and sulfonates are particularly preferred.

Alcohol precursors to the sulfates and ether sulfates can be purchased or synthesized. Suitable Guerbet alcohols, which have a —$CH_2$— "bridge" to the hydroxyl group, are commercially available from Sasol (ISOFOL® alcohols), BASF (e.g., Eutanol® alcohols), Lubrizol, and other suppliers. Commercially available examples include 2-butyl-1-decanol, 2-hexyl-1-octanol, 2-hexyl-1-decanol, 2-hexyl-1-dodecanol, and the like. Suitable Guerbet alcohols can also be synthesized. In the classical synthetic approach, the Guerbet alcohol is made by reacting two moles of an aliphatic alcohol at elevated temperature in the presence of a suitable catalyst to induce oxidation of the alcohol to an aldehyde, aldol condensation, dehydration, and hydrogenation to provide the resulting Guerbet product. Suitable catalysts include, among others, nickel, lead salts (see, e.g., U.S. Pat. No. 3,119,880), oxides of copper, lead, zinc, and other metals (U.S. Pat. No. 3,558,716), or palladium and silver compounds (see, e.g., U.S. Pat. Nos. 3,979,466 or 3,864,407). The reaction of two moles of 1-octanol to give 2-hexyl-1-decanol is illustrative:

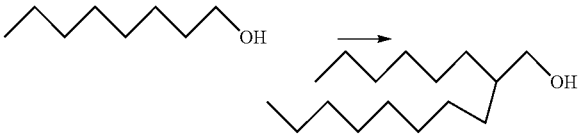

Methylene-bridged alcohols similar to Guerbet alcohols and suitable for use herein can also be made by the hydroformylation of internal olefins, preferably using a catalyst that avoids or minimizes the degree of isomerization of the carbon-carbon double bond (see, e.g., Frankel, *J. Am. Oil. Chem. Soc.* 48 (1971) 248). Internal olefins can be made numerous ways, including, for instance by self-metathesis of alpha-olefins. The synthesis of 2-hexyl-1-nonanol from 1-octene illustrates this approach:

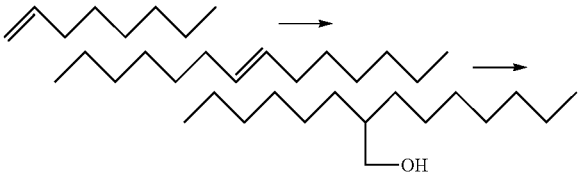

Methylene-bridged alcohols suitable for use can also be made in a multi-step synthesis starting from an aldehyde, which is converted to an imine (e.g., with cyclohexylamine), deprotonated, alkylated, deprotected, and then reduced to give the desired alcohol. The synthesis of 2-heptyl-1-decanol from nonanal and 1-bromooctane, which is detailed below in the experimental section, is an example:

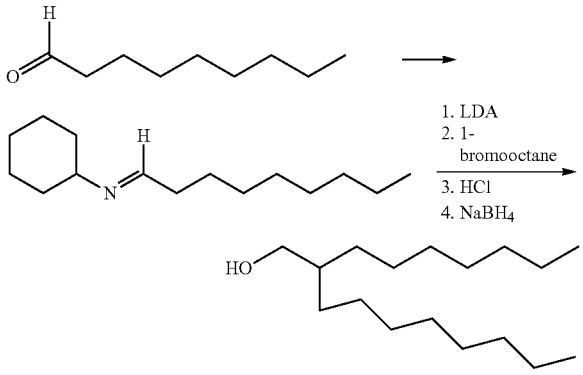

Methylene-bridged alcohols suitable for use can also be made by the hydroboration of vinylidenes produced by dimerizing alpha-olefins. Both the olefin dimerization reaction and hydroboration/oxidation steps are highly selective. The olefin dimerization step to produce the vinylidene can be catalyzed by alkylaluminum compounds (see, e.g., U.S. Pat. Nos. 3,957,664, 4,973,788, 5,625,105, 5,659,100, 6,566,319, and references cited therein, the teachings of which are incorporated herein by reference), metallocene/alumoxane mixtures (see, e.g., U.S. Pat. No. 4,658,078), or the like. Hydroboration and oxidation proceeds with diborane to give almost exclusively the primary alcohol (see H. C. Brown, *Hydroboration* (1962) W. A. Benjamin, pp. 12-13, 114-115). The preparation of 2-hexyl-1-decanol from 1-octene illustrates this approach:

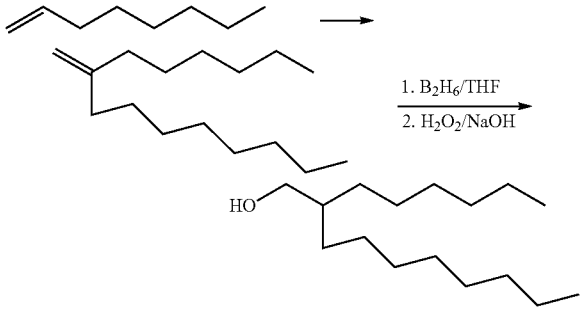

The vinylidenes can also be used to make the dimethylene (—$CH_2CH_2$—) bridged alcohols. Dimethylene-bridged alcohols can be made, for instance, by the hydroformylation of vinylidenes using catalysts that minimize isomerization and production of methyl-branched isomers. Although methyl branching has been considered advantageous for enhancing biodegradability (see PCT Int. Appl. No. WO 2013/181083), the objective here is to maximize formation of product having mid-chain polar groups and to minimize other products, including the methyl-branched hydroformylation products. Suitable hydroformylation catalysts and reaction conditions for selectively adding the CO to the vinylidene terminus are disclosed in GB 2451325 and U.S. Pat. Nos. 3,952,068 and 3,887,624, the teachings of which are incorporated herein by reference. For instance:

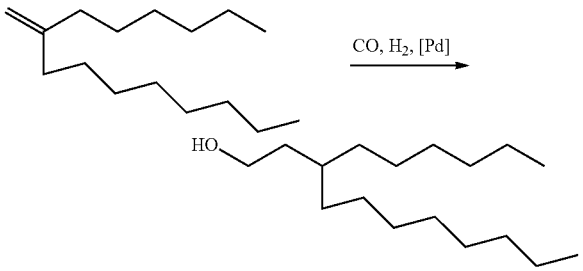

Dimethylene-bridged alcohols can also be made by simply heating the vinylidene with paraformaldehyde (or another source of formaldehyde), followed by catalytic hydrogenation of the resulting mixture of allylic alcohols (one regioisomer shown below) according to the method taught by Kashimura et al. (JP 2005/298443):

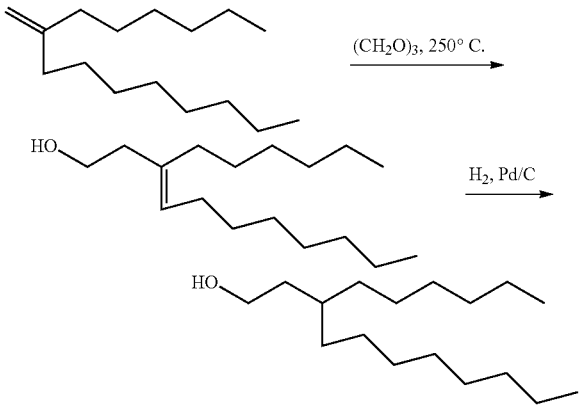

The alcohol sulfates are conveniently made by reacting the corresponding alkylene-bridged alcohol with a sulfating agent according to known methods (see, e.g., U.S. Pat. No. 3,544,613, the teachings of which are incorporated herein by reference). Sulfamic acid is a convenient reagent that sulfates the hydroxyl group without disturbing any unsaturation present in the alkyl chain. Thus, warming the alcohol with sulfamic acid optionally in the presence of urea or another proton acceptor conveniently provides the desired alkyl ammonium sulfate. The ammonium sulfate is easily converted to an alkali metal sulfate by reaction with an alkali metal hydroxide (e.g., sodium hydroxide) or other ion-exchange reagents (see preparation of sodium 2-hexyl-1-decyl sulfate, below). Other suitable sulfating agents include sulfur trioxide, oleum, and chlorosulfonic acid.

When an alcohol alkoxylate is desired, the alcohol precursor is reacted with ethylene oxide, propylene oxide, butylene oxide, or the like, or mixtures thereof, usually in the presence of a base (e.g., KOH), a double metal cyanide (DMC) complex (see, e.g., U.S. Pat. No. 5,482,908), or other catalyst, to add a desired average number of oxyalkylene units. Ethylene oxide is particularly preferred. Typically, the number of oxyalkylene units ranges from 0.5 to 100, preferably from 1 to 30, more preferably from 1 to 10.

When an ether sulfate is desired, the alcohol precursor is first alkoxylated as described above. Sulfation of the alcohol alkoxylate (usually an alcohol ethoxylate) gives the desired ether sulfate.

In one aspect, the alkylene-bridged surfactant is an alcohol sulfate, an alcohol alkoxylate, or an ether sulfate of a $C_{14}$ fatty alcohol. Preferred alcohols in this group include, for example, 2-hexyl-1-octanol, 2-pentyl-1-nonanol, 2-butyl-1-decanol, 2-propyl-1-undecanol, 3-pentyl-1-nonanol, 3-butyl-1-decanol, 3-propyl-1-undecanol, and mixtures thereof.

In another aspect, the alkylene-bridged surfactant is an alcohol sulfate, an alcohol alkoxylate, or an ether sulfate of a $C_{15}$ fatty alcohol. Preferred alcohols in this group include, for example, 2-hexyl-1-nonanol, 2-pentyl-1-decanol, 2-butyl-1-undecanol, 3-hexyl-1-nonanol, 3-pentyl-1-decanol, 3-butyl-1-undecanol, 3-propyl-1-dodecanol, and mixtures thereof.

In another aspect, the alkylene-bridged surfactant is an alcohol sulfate, an alcohol ethoxylate, or an ether sulfate of a $C_{17}$ fatty alcohol. Preferred alcohols in this group include, for example, 2-heptyl-1-nonanol, 2-hexyl-1-decanol, 2-pentyl-1-undecanol, 2-butyl-1-dodecanol, 3-hexyl-1-decanol, 3-pentyl-1-undecanol, 3-butyl-1-dodecanol, and mixtures thereof.

In another aspect, the alkylene-bridged surfactant is an alcohol sulfate, an alcohol alkoxylate, or an ether sulfate of a $C_{17}$ fatty alcohol. Preferred alcohols in this group include, for example, 2-heptyl-1-decanol, 2-hexyl-1-undecanol, 2-pentyl-1-dodecanol, 3-heptyl-1-decanol, 3-hexyl-1-undecanol, 3-pentyl-1-dodecanol, 3-butyl-1-tridecanol, and mixtures thereof.

In another aspect, the alkylene-bridged surfactant is an alcohol sulfate, an alcohol alkoxylate, or an ether sulfate of a $C_{18}$ fatty alcohol. Preferred alcohols in this group include, for example, 2-octyl-1-decanol, 2-heptyl-1-undecanol, 2-hexyl-1-dodecanol, 2-pentyl-1-tridecanol, 3-heptyl-1-undecanol, 3-hexyl-1-dodecanol, 3-pentyl-1-tridecanol, and mixtures thereof.

In yet another aspect, the alkylene-bridged surfactant is an alcohol sulfate, an alcohol alkoxylate, or an ether sulfate of a $C_{19}$ fatty alcohol. Preferred alcohols in this group include, for example, 2-octyl-1-undecanol, 2-heptyl-1-dodecanol, 2-hexyl-1-tridecanol, 3-octyl-1-undecanol, 3-heptyl-1-dodecanol, 3-hexyl-1-tridecanol, 3-pentyl-1-tetradecanol, and mixtures thereof.

In other preferred aspects, the alkylene-bridged surfactant includes, in addition to the polar group, a $C_{14}$-$C_{19}$ alkyl moiety that includes a $C_{12}$-$C_{18}$ alkyl chain and a $C_1$-$C_2$ alkylene group bonded to a central zone carbon of the $C_{12}$-$C_{18}$ alkyl chain. Preferred $C_{14}$ alkyl moieties include, for example, 2-hexyl-1-octyl, 2-pentyl-1-nonyl, 2-butyl-1-decyl, 2-propyl-1-undecyl, 3-pentyl-1-nonyl, 3-butyl-1-decyl, and 3-propyl-1-undecyl. Preferred $C_{15}$ alkyl moieties include, for example, 2-hexyl-1-nonyl, 2-pentyl-1-decyl, 2-butyl-1-undecyl, 3-hexyl-1-nonyl, 3-pentyl-1-decyl, 3-butyl-1-undecyl, and 3-propyl-1-dodecyl. Preferred $C_{16}$ alkyl moieties include, for example, 2-heptyl-1-nonyl, 2-hexyl-1-decyl, 2-pentyl-1-undecyl, 2-butyl-1-dodecyl, 3-hexyl-1-decyl, 3-pentyl-1-undecyl, and 3-butyl-1-dodecyl. Preferred $C_{17}$ alkyl moieties include, for example, 2-heptyl-1-decyl, 2-hexyl-1-undecyl, 2-pentyl-1-dodecyl, 3-heptyl-1-decyl, 3-hexyl-1-undecyl, 3-pentyl-1-dodecyl, and 3-butyl-1-tridecyl. Preferred $C_{18}$ alkyl moieties include, for example, 2-octyl-1-decyl, 2-heptyl-1-undecyl, 2-hexyl-1-dodecyl, 2-pentyl-1-tridecyl, 3-heptyl-1-undecyl, 3-hexyl-1-dodecyl, and 3-pentyl-1-tridecyl. Preferred $C_{19}$ alkyl moieties include, for example, 2-octyl-1-undecyl, 2-heptyl-1-dodecyl, 2-hexyl-1-tridecyl, 3-octyl-1-undecyl, 3-heptyl-1-dodecyl, 3-hexyl-1-tridecyl, and 3-pentyl-1-tetradecyl.

Suitable sulfonates can be made by reacting olefins with a sulfonating or sulfitating agent. The unsaturation in the olefin is preferably in a $C_1$-$C_2$ branching group. For instance, the vinylidenes described earlier have the unsaturation in a $C_1$ branching group. Suitable olefins having unsaturation in a $C_2$ branching group can be made by hydroformylating vinylidenes, followed by dehydration of the alcohol product.

Sulfonation is performed using well-known methods, including reacting the olefin with sulfur trioxide, chlorosulfonic acid, fuming sulfuric acid, or other known sulfonating agents. Chlorosulfonic acid is a preferred sulfonating agent. The sultones that are the immediate products of reacting olefins with $SO_3$, chlorosulfonic acid, and the like may be subsequently subjected to hydrolysis and neutralization with aqueous caustic to afford mixtures of alkene sulfonates and hydroxyalkane sulfonates. Suitable methods for sulfonating olefins are described in U.S. Pat. Nos. 3,169,142; 4,148,821; and U.S. Pat. Appl. Publ. No. 2010/0282467, the teachings of which are incorporated herein by reference. As noted above, vinylidenes can be used as starting materials for the sulfonation; GB 1139158, e.g., teaches sulfonation of 2-hexyl-1-decene to make a product comprising mostly alkene sulfonates.

Sulfitation is accomplished by combining an olefin in water (and usually a cosolvent such as isopropanol) with at least a molar equivalent of a sulfitating agent using well-known methods. Suitable sulfitating agents include, for example, sodium sulfite, sodium bisulfite, sodium metabisulfite, or the like. Optionally, a catalyst or initiator is included, such as peroxides, iron, or other free-radical initiators. Typically, the reaction is conducted at 15-100° C. until reasonably complete. Suitable methods for sulfitating olefins appear in U.S. Pat. Nos. 2,653,970; 4,087,457; 4,275,013, the teachings of which are incorporated herein by reference.

Sulfonation or sulfitation of the olefins may provide reaction products that include one or more of alkanesulfonates, alkenesulfonates, sultones, and hydroxy-substituted alkanesulfonates. The scheme below illustrates hydroxy-substituted alkanesulfonates and alkenesulfonates that can be generated from sulfonation of the $C_2$-branched olefin:

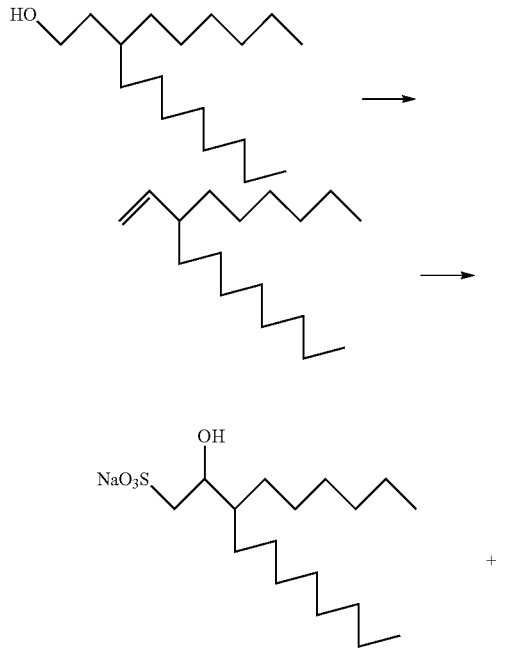

-continued

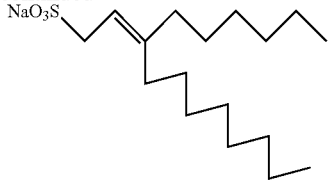

Alkylene-bridged arylsulfonates can be made by alkylating arenes such as benzene, toluene, xylenes, or the like, with vinylidenes or other olefins having unsaturation in a $C_1$-$C_2$ branching group, followed by sulfonation of the aromatic ring and neutralization.

Suitable alcohol phosphates can be made by reacting the alcohol precursors or the alcohol alkoxylates described above with phosphoric anhydride, polyphosphoric acid, or the like, or mixtures thereof according to well-known methods. See, for example, D. Tracy et al., *J. Surf. Det.* 5 (2002) 169 and U.S. Pat. Nos. 6,566,408; 5,463,101; and 5,550,274, the teachings of which are incorporated herein by reference.

The alcohol precursors to alkylene-bridged surfactants mentioned above can be converted to the corresponding primary, secondary, or tertiary amines by an amination process. In some cases, it may be more desirable to make the amines through an intermediate such as a halide or other compound having a good leaving group. Amination is preferably performed in a single step by reacting the corresponding fatty alcohol with ammonia or a primary or secondary amine in the presence of an amination catalyst. Suitable amination catalysts are well known. Catalysts comprising copper, nickel, and/or alkaline earth metal compounds are common. For suitable catalysts and processes for amination, see U.S. Pat. Nos. 5,696,294; 4,994,622; 4,594,455; 4,409,399; and 3,497,555, the teachings of which are incorporated herein by reference.

The alkylene-bridged amine oxides and quaterniums are conveniently available from the corresponding tertiary amines by oxidation or quaternization. The alkylene-bridged betaines and sulfobetaines are conveniently available from the corresponding tertiary amines by reaction with, e.g., sodium monochloroacetate (betaines) or sodium metabisulfite and epichlorohydrin in the presence of base (sulfobetaines). For examples of how to prepare quaterniums, betaines, and sulfobetaines, see PCT Int. Publ. No. WO2012/061098, the teachings of which are incorporated herein by reference. An illustrative sequence:

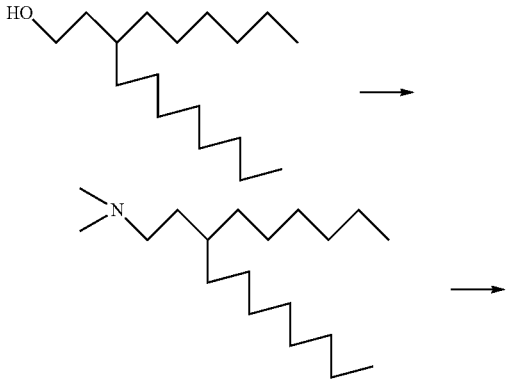

quaternium, amine oxide, betaine, or sulfobetaine

Cold-Water Cleaning

In other aspects, the invention relates to cold-water cleaning methods that utilize laundry detergents comprising a lipase and either a mid-chain headgroup surfactant or an alkylene-bridged surfactant as described above.

"Cold water" means water having a temperature less than 30° C., preferably from 5° C. to 28° C., more preferably 8° C. to 25° C. Depending on climate, sourced water will have a temperature in this range without requiring added heat.

Preferably, the detergents comprise water in addition to the lipase and mid-chain headgroup or alkylene-bridged surfactant. The amount of water present may vary over a wide range and will normally depend on the intended application, the form in which the detergent is delivered, the desired actives level, and other factors. In actual use, the detergents will normally be diluted with a small, large, or very large proportion of water, depending on the equipment available for washing. Generally, the amount of water used will be effective to give 0.001 to 5 wt. % of active surfactant in the wash.

Preferred detergents comprise 1 to 20 wt. %, more preferably 2 to 15 wt. %, of the mid-chain headgroup or alkylene-bridged surfactant (based on 100% actives).

In addition to the mid-chain headgroup or alkylene-bridged surfactant, the detergents used in the cold-water cleaning method may comprise some proportion of alkyl-branched surfactant components. Preferably, the detergents comprise at most only a minor proportion of alkyl-branched components. In one aspect, the mid-chain headgroup or alkylene-bridged surfactant has a minor proportion of methyl or ethyl branches on the longest continuous alkyl chain or on the alkylene bridge. In a preferred aspect, at least 50 mole %, more preferably at least 70 mole %, of the mid-chain headgroup or alkylene-bridged surfactant is essentially free of methyl or ethyl branching.

Detergents of the invention provide improved cold-water cleaning performance. It is common in the field to launder stained fabric swatches under carefully controlled conditions to measure a stain removal index (SRI). Details of the procedure appear in the experimental section below. The inventive lipase-containing detergents can provide a stain removal index improvement of at least 1.0 unit, preferably at least 2.0 units, at the same wash temperature less than 30° C. on at least one greasy soil when compared with the stain removal index provided by a similar detergent comprising a mid-chain headgroup or alkylene-bridged surfactant but without the lipase included. Greasy soils include, for example, bacon grease, beef tallow, butter, cooked beef fat, solid oils, vegetable waxes, petroleum waxes, and the like. On the SRI scale, differences of 0.5 units are distinguishable with the naked eye.

In certain preferred aspects, the detergent compositions further comprise a nonionic surfactant, which is preferably a fatty alcohol ethoxylate.

In other preferred aspects, the detergents further comprise an anionic surfactant, preferably one selected from linear alkylbenzene sulfonates, fatty alcohol ethoxylate sulfates, fatty alcohol sulfates, and mixtures thereof.

In another preferred aspect, the detergent is in the form of a liquid, powder, paste, granule, tablet, or molded solid, or a water-soluble sheet, sachet, or pod.

In another preferred aspect, the detergent further comprises water, a fatty alcohol ethoxylate, and an anionic surfactant selected from linear alkylbenzene sulfonates, fatty alcohol ethoxylate sulfates, and fatty alcohol sulfates.

In another preferred aspect, the detergent comprises 5 to 15 wt. % of a fatty alcohol ethoxylate, 1 to 20 wt. % of a mid-chain headgroup or alkylene-bridged surfactant, and 5 to 15 wt. % of anionic surfactant selected from linear alkylbenzene sulfonates, fatty alcohol ethoxylate sulfates, and fatty alcohol sulfates.

In one aspect, the detergent may comprise a mid-chain headgroup or alkylene-bridged surfactant, water, a solvent, a hydrotrope, an auxiliary surfactant, or mixtures thereof. The solvent and/or auxiliary surfactant and hydrotrope usually help to compatibilize a mixture of water and the mid-chain headgroup or alkylene-bridged surfactant. An "incompatible" mixture of water and a mid-chain headgroup or alkylene-bridged surfactant (absent a solvent and/or auxiliary) is opaque at temperatures between about 15° C. and 25° C. This product form is difficult to ship and difficult to formulate into commercial detergent formulations. In contrast, a "compatible" mixture of water and a mid-chain headgroup or alkylene-bridged surfactant is transparent or translucent, and it flows readily when poured or pumped at temperatures within the range of about 15° C. to 25° C. This product form provides ease of handling, shipping, and formulating from a commercial perspective.

Suitable solvents include, for example, isopropanol, ethanol, 1-butanol, ethylene glycol n-butyl ether, the Dowanol® series of solvents, propylene glycol, butylene glycol, propylene carbonate, ethylene carbonate, solketal, and the like. Preferably, the composition should comprise less than 25 wt. %, more preferably less than 15 wt. %, and most preferably less than 10 wt. % of the solvent (based on the combined amounts of mid-chain headgroup or alkylene-bridged surfactant, solvent, hydrotrope, and any auxiliary surfactant).

Hydrotropes have the ability to increase the water solubility of organic compounds that are normally only slightly soluble in water. Suitable hydrotropes for formulating detergents for cold water cleaning are preferably short-chain surfactants that help to solubilize other surfactants. Preferred hydrotropes for use herein include, for example, aryl sulfonates (e.g., cumene sulfonates, xylene sulfonates), short-chain alkyl carboxylates, sulfosuccinates, urea, short-chain alkyl sulfates, short-chain alkyl ether sulfates, and the like, and combinations thereof. When a hydrotrope is present, the composition preferably comprises less than 25 wt. %, more preferably less than 10 wt. % of the hydrotrope (based on the combined amounts of mid-chain headgroup or alkylene-bridged surfactant, solvent, hydrotrope, and any auxiliary surfactant).

Suitable auxiliary surfactants include, for example, N,N-diethanol oleamide, N,N-diethanol $C_8$ to $C_{18}$ saturated or unsaturated fatty amides, ethoxylated fatty alcohols, alkyl polyglucosides, alkyl amine oxides, N,N-dialkyl fatty amides, oxides of N,N-dialkyl aminopropyl fatty amides, N,N-dialkyl aminopropyl fatty amides, alkyl betaines, linear $C_{12}$-$C_{18}$ sulfates or sulfonates, alkyl sulfobetaines, alkylene oxide block copolymers of fatty alcohols, alkylene oxide block copolymers, and the like. Preferably, the composition should comprise less than 25 wt. %, more preferably less than 15 wt. %, and most preferably less than 10 wt. % of the auxiliary surfactant (based on the combined amounts of mid-chain headgroup or alkylene-bridged surfactant, auxiliary surfactant, and any solvent).

In other preferred aspects, the cold-water cleaning method is performed using particular laundry detergent formulations comprising a lipase and a mid-chain headgroup or alkylene-bridged surfactant.

One such laundry detergent composition comprises 5 to 95 wt. % of a detergent comprising a lipase and a mid-chain headgroup or alkylene-bridged surfactant and has a pH within the range of 7 to 10. This detergent further comprises:

0% to 50% by weight of at least one nonionic surfactant;

0% to 25% by weight of at least one alcohol ether sulfate; and a sufficient amount of at least two enzymes selected from the group consisting of cellulases, hemicellulases, peroxidases, proteases, gluco-amylases, amylases, cutinases, pectinases, xylanases, reductases, oxidases, phenoloxidases, lipoxygenases, ligninases, pullulanases, tannases, pentosanases, malanases, beta-glucanases, arabinosidases, and derivatives thereof.

Another such laundry detergent composition comprises 5 to 95 wt. % of a detergent comprising a lipase and a mid-chain headgroup or alkylene-bridged surfactant and has a pH within the range of 7 to 10. This detergent further comprises:

0% to 50% by weight of at least one nonionic surfactant;

0% to 25% by weight of at least one alcohol ether sulfate; and a sufficient amount of an enzyme selected from the group consisting of cellulases, hemicellulases, peroxidases, proteases, gluco-amylases, amylases, cutinases, pectinases, xylanases, reductases, oxidases, phenoloxidases, lipoxygenases, ligninases, pullulanases, tannases, pentosanases, malanases, beta-glucanases, arabinosidases, and derivatives thereof.

Another such laundry detergent composition comprises 5 to 95 wt. % of a detergent comprising a lipase and a mid-chain headgroup or alkylene-bridged surfactant, has a pH within the range of 7 to 12, and is, except for the lipase, substantially free of enzymes. This detergent further comprises:

0% to 50% by weight of at least one nonionic surfactant; and

0% to 25% by weight of at least one alcohol ether sulfate.

Another such laundry detergent composition comprises 5 to 95 wt. % of a detergent comprising a lipase and a mid-chain headgroup or alkylene-bridged surfactant and has a pH within the range of 7 to 12. This detergent further comprises:

4% to 50% by weight of at least one $C_{16}$ α-methyl ester sulfonate; and

0% to 25% by weight of cocamide diethanolamine.

Another such laundry detergent composition comprises 5 to 95 wt. % of a detergent comprising a lipase and a mid-chain headgroup or alkylene-bridged surfactant and has a pH greater than 10. This detergent further comprises:

0% to 50% by weight of at least one nonionic surfactant;

0% to 25% by weight of at least one alcohol ether sulfate; and 0.1% to about 5% by weight of metasilicate.

Another such laundry detergent composition comprises 5 to 95 wt. % of a detergent comprising a lipase and a mid-chain headgroup or alkylene-bridged surfactant and has a pH greater than 10. This detergent further comprises:

0% to 50% by weight of at least one nonionic surfactant;

0% to 25% by weight of at least one alcohol ether sulfate; and 0.1% to 20% by weight of sodium carbonate.

Another such laundry detergent composition comprises 2 to 95 wt. % of a detergent comprising a lipase and a mid-chain headgroup or alkylene-bridged surfactant. This detergent further comprises:

2% to 40% by weight of at least one nonionic surfactant;

0% to 32% by weight of at least one alcohol ether sulfate;

0% to 25% by weight of at least one $C_{16}$ α-methyl ester sulfonate;

0% to 6% by weight of lauryl dimethylamine oxide;

0% to 6% by weight of $C_{12}EO_3$;
0% to 10% by weight of coconut fatty acid;
0% to 3% by weight of borax pentahydrate;
0% to 6% by weight of propylene glycol;
0% to 10% by weight of sodium citrate;
0% to 6% by weight of triethanolamine;
0% to 6% by weight of monoethanolamine;
0% to 1% by weight of at least one fluorescent whitening agent;
0% to 1.5% by weight of at least one anti-redeposition agent;
0% to 2% by weight of at least one thickener;
0% to 2% by weight of at least one thinner;
0% to 2% by weight of at least one protease;
0% to 2% by weight of at least one amylase; and
0% to 2% by weight of at least one cellulase.

Yet another such laundry detergent composition comprises 2 to 95 wt. % of a detergent comprising a lipase and a mid-chain headgroup or alkylene-bridged surfactant. This detergent further comprises:

2% to 40% by weight of at least one nonionic surfactant;
0% to 32% by weight of at least one alcohol ether sulfate;
0% to 6% by weight of lauryl dimethylamine oxide;
0% to 6% by weight of $C_{12}EO_3$;
0% to 10% by weight of coconut fatty acid;
0% to 10% by weight of sodium metasilicate;
0% to 10% by weight of sodium carbonate;
0% to 1% by weight of at least one fluorescent whitening agent;
0% to 1.5% by weight of at least one anti-redeposition agent;
0% to 2% by weight of at least one thickener; and
0% to 2% by weight of at least one thinner.

Another "green" laundry detergent composition comprises 2 to 95 wt. % of a detergent comprising a lipase and a mid-chain headgroup or alkylene-bridged surfactant. This detergent further comprises:

0% to 30% by weight of at least one $C_{16}$ methyl ester sulfonate;
0% to 30% by weight of at least one $C_{12}$ methyl ester sulfonate;
0% to 30% by weight of sodium lauryl sulfate;
0% to 30% by weight of sodium stearoyl lactylate;
0% to 30% by weight of sodium lauroyl lactate;
0% to 60% by weight of alkyl polyglucoside;
0% to 60% by weight of polyglycerol monoalkylate;
0% to 30% by weight of lauryl lactyl lactate;
0% to 30% by weight of saponin;
0% to 30% by weight of rhamnolipid;
0% to 30% by weight of sphingolipid;
0% to 30% by weight of glycolipid;
0% to 30% by weight of at least one abietic acid derivative; and
0% to 30% by weight of at least one polypeptide.

In one aspect, the lipase and mid-chain headgroup or alkylene-bridged surfactant are used in a laundry pre-spotter composition. In this application, greasy or oily soils on the garments or textile fabrics are contacted directly with the pre-spotter in advance of laundering either manually or by machine. Preferably, the fabric or garment is treated for 5-30 minutes. The amount of active mid-chain headgroup or alkylene-bridged surfactant in the pre-spotter composition is preferably 0.5 to 50 wt. %, more preferably 1 to 30 wt. %, and most preferably 5 to 20 wt. %. Treated fabric is machine laundered as usual, preferably at a temperature within the range of 5° C. and 30° C., more preferably 10° C. to 20° C., most preferably 12° C. to 18° C.

In another aspect, the lipase and mid-chain headgroup or alkylene-bridged surfactant are used in a pre-soaker composition for manual or machine washing.

When used for manual washing, the pre-soaker composition is combined with cold water in a washing tub or other container. The amount of active mid-chain headgroup or alkylene-bridged surfactant in the pre-soaker composition is preferably 0.5 to 100 wt. %, more preferably 1 to 80 wt. %, and most preferably 5 to 50 wt. %. Garments or textile fabrics are preferably saturated with pre-soaker in the tub, allowed to soak for 15-30 minutes, and laundered as usual.

When used for machine washing, the pre-soaker composition is preferably added to a machine containing water at a temperature within the range of 5° C. and 30° C., more preferably 10° C. to 20° C., most preferably 12° C. to 18° C. The amount of active mid-chain headgroup or alkylene-bridged surfactant in the pre-soaker composition is preferably 0.5 to 100 wt. %, more preferably 1 to 80 wt. %, and most preferably 5 to 50 wt. %. Garments/textile fabrics are added to the machine, allowed to soak (usually with a pre-soak cycle selected on the machine) for 5-10 minutes, and then laundered as usual.

In another aspect, the lipase and mid-chain headgroup or alkylene-bridged surfactant are used as an additive for a laundry product or formulation. In such applications, the surfactant helps to improve or boost the grease removal or grease cutting performance of the laundry product or formulation. Preferably, the amount of mid-chain headgroup or alkylene-bridged surfactant actives used will be within the range of 1 to 10 wt. %, more preferably 2 to 8 wt. %, and most preferably 3 to 5 wt. %. The laundry product or formulation and the mid-chain headgroup or alkylene-bridged surfactant are preferably mixed until a homogeneous composition is obtained.

In yet another aspect, the lipase and mid-chain headgroup or alkylene-bridged surfactant are used as a surfactant additive. In such applications, the resulting modified surfactant will have improved grease removal or grease cutting properties. Preferably, the amount of mid-chain headgroup or alkylene-bridged surfactant actives used will be within the range of 1 to 10 wt. %, more preferably 2 to 8 wt. %, and most preferably 3 to 5 wt. %. The resulting modified surfactant will help to achieve improved grease cutting/removal in commercial products. Such products may be used at a temperature within the range of 5° C. and 30° C., preferably 10° C. to 20° C., and more preferably 12° C. to 18° C.

General Considerations for Heavy Duty Liquid (HDL) Laundry Detergents

Desirable surfactant attributes for HDLs include being in liquid form at room temperature, an ability to be formulated in cold-mix applications, and an ability to perform as well as or better than existing surfactants.

Desirable attributes for HDLs include, for example, the ability to emulsify, suspend or penetrate greasy or oily soils and suspend or disperse particulates, in order to clean surfaces; and then prevent the soils, grease, or particulates from re-depositing on the newly cleaned surfaces.

It is also desirable to have the ability to control the foaming—for use of an HDL in a high efficiency (it should be appreciated that all high efficiency ("HE") washing machines includes all front loading washing machines as well) washing machine, low foam is desired to achieve the best cleaning and to avoid excess foaming. Other desirable properties include the ability to clarify the formulation and to improve long-term storage stability under both extreme outdoor and normal indoor temperatures.

The skilled person will appreciate that the mid-chain headgroup or alkylene-bridged surfactants of the present disclosure will usually not be mere "drop-in" substitutions in an existing detergent formulation. Some amount of reformulation is typically necessary to adjust the nature and amounts of other surfactants, hydrotropes, alkalinity control agents, and/or other components of the formulation in order to achieve a desirable outcome in terms of appearance, handling, solubility characteristics, and other physical properties and performance attributes. For example, a formulation might need to be adjusted by using, in combination with the mid-chain headgroup or alkylene-bridged surfactant, a more highly ethoxylated nonionic surfactant instead of one that has fewer EO units. This kind of reformulating is considered to be within ordinary skill and is left to the skilled person's discretion.

Detergent Compositions

A wide variety of detergent compositions can be made that include the mid-chain headgroup or alkylene-bridged surfactants, with or without other ingredients as specified below. Formulations are contemplated including 1% to 99% mid-chain headgroup or alkylene-bridged surfactant, more preferably between 1% and 60%, even more preferably between 1% and 30%, with 99% to 1% water and, optionally, other ingredients as described here.

Surfactants

The detergent compositions can contain co-surfactants, which can be anionic, cationic, nonionic, ampholytic, zwitterionic, or combinations of these.

Anionic Surfactants

Formulations useful for the method of the invention can include anionic surfactants in addition to the mid-chain headgroup or alkylene-bridged surfactant. "Anionic surfactants" are defined here as amphiphilic molecules with an average molecular weight of less than about 10,000, comprising one or more functional groups that exhibit a net anionic charge when present in aqueous solution at the normal wash pH, which can be a pH between 6 and 11. The anionic surfactant can be any anionic surfactant that is substantially water soluble. "Water soluble" surfactants are, unless otherwise noted, here defined to include surfactants which are soluble or dispersible to at least the extent of 0.01% by weight in distilled water at 25° C. At least one of the anionic surfactants used may be an alkali or alkaline earth metal salt of a natural or synthetic fatty acid containing between about 4 and about 30 carbon atoms. A mixture of carboxylic acid salts with one or more other anionic surfactants can also be used. Another important class of anionic compounds is the water soluble salts, particularly the alkali metal salts, of organic sulfur reaction products having in their molecular structure an alkyl radical containing from about 6 to about 24 carbon atoms and a radical selected from the group consisting of sulfonic and sulfuric acid ester radicals.

Specific types of anionic surfactants are identified in the following paragraphs. In some aspects, alkyl ether sulfates are preferred. In other aspects, linear alkyl benzene sulfonates are preferred.

Carboxylic acid salts are represented by the formula:

$$R^1COOM$$

where $R^1$ is a primary or secondary alkyl group of 4 to 30 carbon atoms and M is a solubilizing cation. The alkyl group represented by $R^1$ may represent a mixture of chain lengths and may be saturated or unsaturated, although it is preferred that at least two thirds of the $R^1$ groups have a chain length of between 8 and 18 carbon atoms. Non-limiting examples of suitable alkyl group sources include the fatty acids derived from coconut oil, tallow, tall oil and palm kernel oil. For the purposes of minimizing odor, however, it is often desirable to use primarily saturated carboxylic acids. Such materials are well known to those skilled in the art, and are available from many commercial sources, such as Uniqema (Wilmington, Del.) and Twin Rivers Technologies (Quincy, Mass.). The solubilizing cation, M, may be any cation that confers water solubility to the product, although monovalent such moieties are generally preferred. Examples of acceptable solubilizing cations for use with the present technology include alkali metals such as sodium and potassium, which are particularly preferred, and amines such as triethanolammonium, ammonium and morpholinium. Although, when used, the majority of the fatty acid should be incorporated into the formulation in neutralized salt form, it is often preferable to leave a small amount of free fatty acid in the formulation, as this can aid in the maintenance of product viscosity.

Primary alkyl sulfates are represented by the formula:

$$R^2OSO_3M$$

where $R^2$ is a primary alkyl group of 8 to 18 carbon atoms and can be branched or linear, saturated or unsaturated. M is H or a cation, e.g., an alkali metal cation (e.g., sodium, potassium, lithium), or ammonium or substituted ammonium (e.g., methyl-, dimethyl-, and trimethylammonium cations and quaternary ammonium cations such as tetramethylammonium and dimethylpiperidinium cations and quaternary ammonium cations derived from alkylamines such as ethylamine, diethylamine, triethylamine, and mixtures thereof, and the like). The alkyl group $R^2$ may have a mixture of chain lengths. It is preferred that at least two-thirds of the $R^2$ alkyl groups have a chain length of 8 to 14 carbon atoms. This will be the case if $R^2$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl ether sulfates are represented by the formula:

$$R^3O(CH_2CH_2O)_nSO_3M$$

where $R^3$ is a primary alkyl group of 8 to 18 carbon atoms, branched or linear, saturated or unsaturated, and n has an average value in the range from 1 to 6 and M is a solubilizing cation. The alkyl group $R^3$ may have a mixture of chain lengths. It is preferred that at least two-thirds of the $R^3$ alkyl groups have a chain length of 8 to 18 carbon atoms. This will be the case if $R^3$ is coconut alkyl, for example. Preferably n has an average value of 2 to 5. Ether sulfates have been found to provide viscosity build in certain of the formulations of the present technology, and thus are considered a preferred ingredient.

Other suitable anionic surfactants that can be used are alkyl ester sulfonate surfactants including linear esters of $C_8$-$C_{20}$carboxylic acids (i.e., fatty acids) which are sulfonated with gaseous $SO_3$ (see, e.g., *J. Am. Oil Chem. Soc.* 52 (1975) 323). Suitable starting materials would include natural fatty substances as derived from tallow, palm oil, and the like.

Preferred alkyl ester sulfonate surfactants, especially for laundry applications, comprise alkyl ester sulfonate surfactants of the structural formula:

$$R^3—CH(SO_3M)-C(O)—OR^4$$

where $R^3$ is a $C_6$-$C_{20}$ hydrocarbyl, preferably an alkyl or combination thereof $R^4$ is a $C_1$-$C_6$ hydrocarbyl, preferably an alkyl, or combination thereof, and M is a cation that forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. The group $R^3$ may have a mixture of chain lengths. Preferably at least two-thirds of these groups have 6 to 12 carbon atoms. This will be the case when the moiety $R^3CH(—)CO_2(—)$ is derived from a coconut source, for instance. Preferably, $R^3$ is $C_{10}$-$C_{16}$ alkyl, and $R^4$ is methyl, ethyl or isopropyl. Especially preferred are the methyl ester sulfonates where $R^3$ is $C_{10}$-$C_{16}$ alkyl.

Alkyl benzene sulfonates are represented by the formula:

$$R^6ArSO_3M$$

where $R^6$ is an alkyl group of 8 to 18 carbon atoms, Ar is a benzene ring ($—C_6H_4—$) and M is a solubilizing cation. The group $R^6$ may be a mixture of chain lengths. A mixture of isomers is typically used, and a number of different grades, such as "high 2-phenyl" and "low 2-phenyl" are commercially available for use depending on formulation needs. Many commercial suppliers exist for these materials, including Stepan, Akzo, Pilot, and Rhodia. Typically, they are produced by the sulfonation of alkylbenzenes, which can be produced by either the HF-catalyzed alkylation of benzene with olefins or an $AlCl_3$-catalyzed process that alkylates benzene with chloroparaffins, and are sold by, for example, Petresa (Chicago, Ill.) and Sasol (Austin, Tex.). Straight chains of 11 to 14 carbon atoms are usually preferred.

Paraffin sulfonates having about 8 to about 22 carbon atoms, preferably about 12 to about 16 carbon atoms, in the alkyl moiety, are contemplated for use here. They are usually produced by the sulfoxidation of petrochemically derived normal paraffins. These surfactants are commercially available as, for example, Hostapur SAS from Clariant (Charlotte, N.C.).

Olefin sulfonates having 8 to 22 carbon atoms, preferably 12 to 16 carbon atoms, are also contemplated for use in the present compositions. The olefin sulfonates are further characterized as having from 0 to 1 ethylenic double bonds; from 1 to 2 sulfonate moieties, of which one is a terminal group and the other is not; and 0 to 1 secondary hydroxyl moieties. U.S. Pat. No. 3,332,880 contains a description of suitable olefin sulfonates, and its teachings are incorporated herein by reference. Examples of specific surfactant species from that patent include the following:

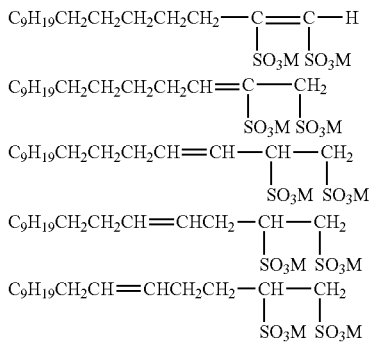

-continued

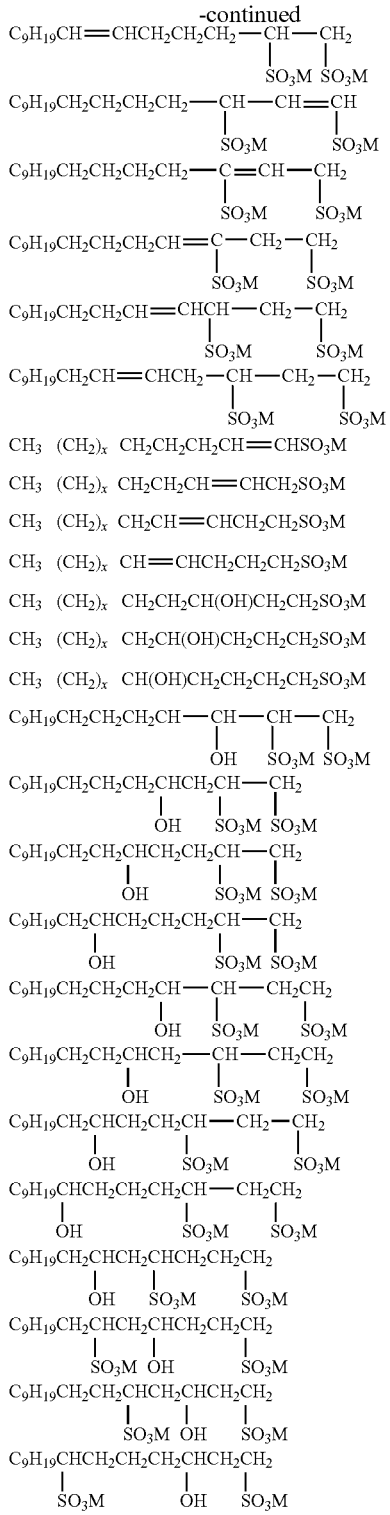

In the preceding formulas, x is an integer of from about 4 to about 18, preferably from about 4 to about 12, and M represents any cation that forms a water-soluble salt such as alkali metals, e.g., sodium and potassium, and ammonium and substituted ammonium compounds, e.g., trialkylammonium and trialkylolammonium compounds. Specific examples of substituted ammonium compounds are triethylammonium, trimethylammonium, and triethanolammonium. Others will be apparent to those skilled in the art. Such materials are sold as, for example, Bio-Terge® AS-40, a product of Stepan.

Sulfosuccinate esters represented by the formula:

$$R^7OOCCH_2CH(SO_3^-M^+)COOR^8$$

are also useful herein as anionic surfactants. $R^7$ and $R^8$ are alkyl groups with chain lengths of between 2 and 16 carbons, and may be linear or branched, saturated or unsaturated. A preferred sulfosuccinate is sodium bis(2-ethylhexyl) sulfosuccinate, which is commercially available under the trade name Aerosol OT from Cytec Industries (West Paterson, N.J.).

Organic phosphate-based anionic surfactants include organic phosphate esters such as complex mono- or diester phosphates of hydroxyl-terminated alkoxide condensates, or salts thereof. Suitable organic phosphate esters include phosphate esters of polyoxyalkylated alkylaryl phenols, phosphate esters of ethoxylated linear alcohols, and phosphate esters of ethoxylated phenols. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Other anionic surfactants useful for detersive purposes can also be included in the detergent compositions. These can include salts (including, for example, sodium, potassium, ammonium, and substituted ammonium salts such as mono-, di- and triethanolamine salts) of soap, $C_8$-$C_{22}$ primary of secondary alkanesulfonates, $C_8$-$C_{24}$ olefin sulfonates, sulfonated polycarboxylic acids prepared by sulfonation of the pyrolyzed product of alkaline earth metal citrates, e.g., as described in British Pat. No. 1,082,179, $C_8$-$C_{24}$ alkyl poly glycol ether sulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$-$C_{18}$ monoesters) and diesters of sulfosuccinates (especially saturated and unsaturated $C_6$-$C_{12}$ diesters), sulfates of alkylpolysaccharides such as the sulfates of alkylpolyglucoside (the nonionic non-sulfated compounds being described below), and alkyl polyethoxy carboxylates such as those of the formula $RO(CH_2CH_2O)_kCH_2COO$-M+ where R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. Nos. 3,929,678 and 6,949,498, the teachings of which are incorporated herein by reference.

Other anionic surfactants contemplated include isethionates, sulfated triglycerides, alcohol sulfates, ligninsulfonates, naphthelene sulfonates and alkyl naphthelene sulfonates, and the like.

Specific anionic surfactants contemplated for use in the present compositions include alcohol ether sulfates (AES), linear alkylbenzene sulfonates (LAS), alcohol sulfates (AS), alpha methyl ester sulfonates (MES), or combinations of two or more of these. The amount of anionic surfactant contemplated can be, for example, 1% to 70% of the composition more preferably between 1% and 60%, even more preferably between 1% and 40%. For a more general description of surfactants, see U.S. Pat. No. 5,929,022, the teachings of which are incorporated herein by reference.

Nonionic and Ampholytic Surfactants

Examples of suitable nonionic surfactants include alkyl polyglucosides ("APGs"), alcohol ethoxylates, nonylphenol ethoxylates, methyl ester ethoxylates ("MEEs"), and others. The nonionic surfactant may be used as from 1% to 90%, more preferably from 1 to 40% and most preferably between 1% and 32% of a detergent composition. Other suitable nonionic surfactants are described in U.S. Pat. No. 5,929,022, from which much of the following discussion comes.

One class of nonionic surfactants useful herein are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic and the length of the polyoxyethylene group which is condensed with any particular hydrophobic group can be readily adjusted to yield a water-soluble compound having the desired degree of balance between hydrophilic and hydrophobic elements.

For "low HLB" nonionics, low HLB can be defined as having an HLB of 8 or less and preferably 6 or less. A "low level" of co-surfactant can be defined as 6% or less of the HDL and preferably 4% or less of the HDL.

Especially preferred nonionic surfactants of this type are the $C_9$-$C_{15}$ primary alcohol ethoxylates containing 3-12 moles of ethylene oxide per mole of alcohol, particularly the $C_{12}$-$C_{15}$ primary alcohols containing 5-8 moles of ethylene oxide per mole of alcohol. One suitable example of such a surfactant is polyalkoxylated aliphatic base, sold for example as Makon® NF-12 by Stepan Company.

Another class of nonionic surfactants comprises alkyl polyglucoside compounds of general formula:

$$RO—(C_nH_{2n}O)_tZ_x$$

where Z is a moiety derived from glucose; R is a saturated hydrophobic alkyl group that contains from 12 to 18 carbon atoms; t is from 0 to 10 and n is 2 or 3; x has an average value from 1.3 to 4. The compounds include less than 10% unreacted fatty alcohol and less than 50% short chain alkyl polyglucosides. Compounds of this type and their use in detergent compositions are disclosed in EP-B 0 070 077, EP 0 075 996 and EP 0 094 118.

Also suitable as nonionic surfactants are polyhydroxy fatty acid amide surfactants of the formula:

$$R^2—C(O)—N(R^1)—Z$$

where $R^1$ is H, or $R^1$ is $C_{1-4}$ hydrocarbyl, 2-hydroxyethyl, 2-hydroxypropyl or a mixture thereof, $R^2$ is $C_5$-$C_{31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Ampholytic synthetic detergents can be broadly described as derivatives of aliphatic or aliphatic derivatives of heterocyclic secondary and tertiary amines, in which the aliphatic radical may be straight chain or branched and where one of the aliphatic substituents contains from about 8 to about 18 carbon atoms and at least one contains an anionic water-solubilizing group, e.g., carboxy, sulfo, sulfato, phosphato, or phosphono (see U.S. Pat. No. 3,664,961, the teachings of which are incorporated herein by reference). Suitable ampholytic surfactants include fatty amine oxides and fatty amidopropylamine oxides. Specific suitable examples are cocoamidopropyl betaine (CAPB) and coco betaine (CB). Ampholytic surfactants can be used at a level from 1% to 50%, more preferably from 1% to 10%, even more preferably between 1% and 5% of the formulation, by weight.

Amine oxide surfactants are highly preferred. Compositions herein may comprise an amine oxide in accordance with the general formula:

$$R^1(EO)_x(PO)_y(BO)_zN(O)(CH_2R')_2 \cdot H_2O$$

In general, it can be seen that the preceding formula provides one long-chain moiety $R^1(EO)_x(PO)_y(BO)_z$ and two short chain moieties, —$CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having a chain length of from about 8 to about 18. When x+y+z is different from 0, $R^1$ may be somewhat longer, having a chain length in the range $C_{12}$-$C_{24}$. The general formula also encompasses amine oxides where x+y+z=0, $R^1$ is $C_8$-$C_{18}$, R' is H and q= from 0 to 2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, the teachings of which are incorporated herein by reference.

Also suitable are amine oxides where x+y+z is different from zero. Specifically, x+y+z is from about 1 to about 10, and $R^1$ is a primary alkyl group containing about 8 to about 24 carbons, preferably from about 12 to about 16 carbon atoms. In these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Preferred amine oxides are solids at ambient temperature. More preferably, they have melting points in the range of 30° C. to 90° C. Amine oxides suitable for use are made commercially by Stepan, Akzo Chemie, Ethyl Corp., Procter & Gamble, and others. See McCutcheon's compilation and a Kirk-Othmer review article for alternate amine oxide manufacturers. Preferred commercially available amine oxides are Ammonyx® LO and Ammonyx® MO surfactants (Stepan).

Preferred detergents include, e.g., hexadecyldimethylamine oxide dihydrate, octadecyldimethylamine oxide dihydrate, hexadecyltris(ethyleneoxy)dimethylamine oxide, and tetradecyldimethylamine oxide dihydrate.

In certain aspects in which R' is H, there is some latitude with respect to having R' slightly larger than H. Specifically, R' may be $CH_2OH$, as in hexadecylbis(2-hydroxyethyl) amine oxide, tallowbis(2-hydroxyethyl)amine oxide, stearylbis(2-hydroxyethyl)amine oxide and oleylbis(2-hydroxyethyl)amine oxide.

Zwitterionic Surfactants

Zwitterionic synthetic detergents can be broadly described as derivatives of aliphatic quaternary ammonium and phosphonium or tertiary sulfonium compounds, in which the cationic atom may be part of a heterocyclic ring, and in which the aliphatic radical may be straight chain or branched, and where one of the aliphatic substituents contains from about 3 to 18 carbon atoms, and at least one aliphatic substituent contains an anionic water-solubilizing group, e.g., carboxy, sulfo, sulfato, phosphato, or phosphono (see U.S. Pat. No. 3,664,961, the teachings of which are incorporated herein by reference). Zwitterionic surfactants can be used as from 1% to 50%, more preferably from 1% to 10%, even more preferably from 1% to 5% by weight of the present formulations.

Mixtures of any two or more individually contemplated surfactants, whether of the same type or different types, are contemplated herein.

Laundry Detergent Composition

The formulation and use of the present surfactants will now be illustrated in more detail for a laundry detergent composition.

Four desirable characteristics of a laundry detergent composition, in particular a liquid composition (although the present disclosure is not limited to a liquid composition, or to a composition having any or all of these attributes) are that (1) a concentrated formulation is useful to save on shelf space of a retailer, (2) a "green" or environmentally friendly composition is useful, (3) a composition that works in modern high efficiency washing machines which use less energy and less water to wash clothes than previous machines is useful, and (4) a composition that cleans well in cold water, i.e., less than 30° C., preferably 5° C. to 30° C.

To save a substantial amount of retailer shelf space, a concentrated formulation is contemplated having two or even three, four, five, six, or even greater (e.g., 8×) times potency per unit volume or dose as conventional laundry detergents. The use of less water complicates the formulation of a detergent composition, as it needs to be more soluble and otherwise to work well when diluted in relatively little water.

To make a "green" formula, the surfactants should be ultimately biodegradable and non-toxic. To meet consumer perceptions and reduce the use of petrochemicals, a "green" formula may also advantageously be limited to the use of renewable hydrocarbons, such as vegetable or animal fats and oils, in the manufacture of surfactants.

High efficiency (HE) washing machines present several challenges to the detergent formulation. As of January 2011, all washing machines sold in the U.S. must be HE, at least to some extent, and this requirement will only become more restrictive in the coming years. Front loading machines, all of which are HE machines, represent the highest efficiency, and are increasingly being used.

Heavy duty liquid detergent formulas are impacted by HE machines because the significantly lower water usage requires that less foam be generated during the wash cycle. As the water usage levels continue to decrease in future generations of HE machines, detergents may be required to transition to no foam. In addition, HE HDLs should also disperse quickly and cleanly at lower wash temperatures.

To work in a modern high efficiency washing machine, the detergent composition needs to work in relatively concentrated form in cold water, as these washing machines use relatively little water and cooler washing temperatures than prior machines. The sudsing of such high-efficiency formulations must also be reduced, or even eliminated, in a low-water environment to provide effective cleaning performance. The anti-redeposition properties of a high efficiency detergent formulation also must be robust in a low-water environment. In addition, formulations that allow the used wash water to be more easily rinsed out of the clothes or spun out of the clothes in a washing machine are also contemplated, to promote efficiency.

Liquid fabric softener formulations and "softergent" (fabric softener/detergent dual functional) single-add formulations also may need to change as water usage continues to decline in HE machines. A washer-added softener is dispensed during the rinse cycle in these machines. The mid-chain headgroup or alkylene-bridged surfactants can be used in formulations that provide softening in addition to cleaning.

Laundry detergents and additives containing the presently described mid-chain headgroup or alkylene-bridged surfactants are contemplated to provide high concentration formulations, or "green" formulations, or formulations that work well in high efficiency washing machines. Such detergents and additives are contemplated that have at least one of the advantages or desirable characteristics specified above, or combinations of two or more of these advantages, at least to some degree. The ingredients contemplated for use in such laundry detergents and additives are found in the following paragraphs.

In addition to the surfactants as previously described, a laundry detergent composition commonly contains other ingredients for various purposes. Some of those ingredients are also described below.

Builders and Alkaline Agents

Builders and other alkaline agents are contemplated for use in the present formulations.

Any conventional builder system is suitable for use here, including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for environmental reasons, phosphate builders could also be used here.

Suitable polycarboxylate builders for use here include citric acid, preferably in the form of a water-soluble salt, and derivatives of succinic acid of the formula:

$$R—CH(COOH)CH_2(COOH)$$

where R is $C_{10-20}$ alkyl or alkenyl, preferably $C_{12}$-$C_{16}$, or where R can be substituted with hydroxyl, sulfo, sulfoxyl, or sulfone substituents. Specific examples include lauryl succinate, myristyl succinate, palmityl succinate, 2-dodecenylsuccinate, or 2-tetradecenyl succinate. Succinate builders are preferably used in the form of their water-soluble salts, including sodium, potassium, ammonium, and alkanolammonium salts.

Other suitable polycarboxylates are oxodisuccinates and mixtures of tartrate monosuccinic and tartrate disuccinic acid, as described in U.S. Pat. No. 4,663,071.

Especially for a liquid detergent composition, suitable fatty acid builders for use here are saturated or unsaturated $C_{10}$-$C_{-18}$ fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid and citric acid.

Some examples of alkaline agents include alkali metal (Na, K, or $NH_4$) hydroxides, carbonates, citrates, and bicarbonates. Another commonly used builder is borax.

For powdered detergent compositions, the builder or alkaline agent typically comprises from 1% to 95% of the composition. For liquid compositions, the builder or alkaline agent typically comprises from 1% to 60%, alternatively between 1% and 30%, alternatively between 2% and 15%. See U.S. Pat. No. 5,929,022, the teachings of which are incorporated by reference, from which much of the preceding discussion comes.

Other builders are described in PCT Int. Publ. WO 99/05242, which is incorporated here by reference.

Additional Enzymes

In addition to the lipase, the detergent compositions may further comprise one or more other enzymes, which provide cleaning performance and/or fabric care benefits. The enzymes include cellulases, hemicellulases, peroxidases, proteases, gluco-amylases, amylases, cutinases, pectinases, xylanases, reductases, oxidases, phenoloxidases, lipoxygenases, ligninases, pullulanases, tannases, pentosanases, malanases, beta-glucanases, arabinosidases or mixtures thereof.

A preferred combination is a detergent composition having, in addition to the lipase, a cocktail of other conventional applicable enzymes like protease, amylase, cutinase and/or cellulase in conjunction with the lipolytic enzyme variant D96L at a level of from 50 LU to 8500 LU per liter of wash solution.

Suitable cellulases include both bacterial or fungal cellulase. Preferably, they will have a pH optimum of between 5 and 9.5. Suitable cellulases are disclosed in U.S. Pat. No. 4,435,307, which discloses fungal cellulase produced from *Humicola insolens*. Suitable cellulases are also disclosed in GB-A-2 075 028; GB-A-2 095 275 and DE-OS-2 247 832.

Examples of such cellulases are cellulases produced by a strain of *Humicola insolens* (*Humicola grisea* var. *thermoidea*), particularly the *Humicola* strain DSM 1800. Other suitable cellulases are cellulases originated from *Humicola insolens* having a molecular weight of about 50,000, an isoelectric point of 5.5 and containing 415 amino acid units. Especially suitable cellulases are the cellulases having color care benefits. Examples of such cellulases are cellulases described in EP Appl. No. 91202879.2.

Peroxidase enzymes are used in combination with oxygen sources, e.g. percarbonate, perborate, persulfate, hydrogen peroxide, and the like. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidases such as chloro- and bromoperoxidase. Peroxidase-containing detergent compositions are disclosed, for example, in PCT Int. Appl. WO 89/099813 and in EP Appl. No. 91202882.6.

The cellulases and/or peroxidases are normally incorporated in the detergent composition at levels from 0.0001% to 2% of active enzyme by weight of the detergent composition.

Preferred commercially available protease enzymes include those sold under the tradenames Alcalase®, Savinase®, Primase®, Durazym®, and Esperase® by Novozymes, those sold under the tradename Maxatase®, Maxacal® and Maxapem® by DSM, those sold by DuPont Industrial Biosciences (formerly Genencor), and those sold under the tradename Opticlean® and Optimase® by Danisco. Other proteases are described in U.S. Pat. No. 5,679,630 can be included in the detergent compositions. Protease enzyme may be incorporated into the detergent compositions at a level of from about 0.0001% to about 2% active enzyme by weight of the composition.

A preferred protease here referred to as "Protease D" is a carbonyl hydrolase variant having an amino acid sequence not found in nature, which is derived from a precursor carbonyl hydrolase by substituting a different amino acid for the amino acid residue at a position in the carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens subtilisin*, as described in U.S. Pat. No. 5,679,630, the teachings of which are incorporated herein by reference.

Also suitable are cutinases [EC 3.1.1.50] which can be considered as a special kind of lipase, namely lipases that do not require interfacial activation. Addition of cutinases to detergent compositions is described, e.g. in PCT Int. Appl. No. WO 88/09367.

The cutinases are normally incorporated in the detergent composition at levels from 0.0001% to 2% of active enzyme by weight of the detergent composition.

Amylases (α and/or β) can be included for removal of carbohydrate-based stains. Suitable amylases are Termamyl®, Fungamyl® and BAN® amylases (Novozymes).

The above-mentioned enzymes may be of any suitable origin, such as vegetable, animal, bacterial, fungal and/or yeast origin. See U.S. Pat. No. 5,929,022, the teachings of which are incorporated herein by reference, from which much of the preceding discussion comes. Preferred compositions optionally contain a combination of enzymes or a single enzyme, with the amount of each enzyme commonly ranging from 0.0001% to 2%.

Other enzymes and materials used with enzymes are described in PCT Int. Appl. No. WO99/05242, which is incorporated here by reference.

Adjuvants

The detergent compositions optionally contain one or more soil suspending agents or resoiling inhibitors in an amount from about 0.01% to about 5% by weight, alternatively less than about 2% by weight. Resoiling inhibitors include anti-redeposition agents, soil release agents, or combinations thereof. Suitable agents are described in U.S. Pat. No. 5,929,022, and include water-soluble ethoxylated amines having clay soil removal and anti-redeposition properties. Examples of such soil release and anti-redeposition agents include an ethoxylated tetraethylenepentamine. Further suitable ethoxylated amines are described in U.S. Pat. No. 4,597,898, the teachings of which are incorporated herein by reference. Another group of preferred clay soil removal/anti-redeposition agents are the cationic compounds disclosed in EP Appl. No. 111,965. Other clay soil removal/anti-redeposition agents which can be used include the ethoxylated amine polymers disclosed in EP Appl. No. 111,984; the zwitterionic polymers disclosed in EP Appl. No. 112,592; and the amine oxides disclosed in U.S. Pat. No. 4,548,744, the teachings of which are incorporated herein by reference.

Other clay soil removal and/or anti-redeposition agents known in the art can also be utilized in the compositions hereof. Another type of preferred anti-redeposition agent includes the carboxymethylcellulose (CMC) materials.

Anti-redeposition polymers can be incorporated into HDL formulations described herein. It may be preferred to keep the level of anti-redeposition polymer below about 2%. At levels above about 2%, the anti-redeposition polymer may cause formulation instability (e.g., phase separation) and or undue thickening.

Soil release agents are also contemplated as optional ingredients in the amount of about 0.1% to about 5% (see, e.g., U.S. Pat. No. 5,929,022).

Chelating agents in the amounts of about 0.1% to about 10%, more preferably about 0.5% to about 5%, and even more preferably from about 0.8% to about 3%, are also contemplated as an optional ingredient (see, e.g., U.S. Pat. No. 5,929,022).

Polymeric dispersing agents in the amount of 0% to about 6% are also contemplated as an optional component of the presently described detergent compositions (see, e.g., U.S. Pat. No. 5,929,022).

A suds suppressor is also contemplated as an optional component of the present detergent composition, in the amount of from about 0.1% to about 15%, more preferably between about 0.5% to about 10% and even more preferably between about 1% to about 7% (see, e.g., U.S. Pat. No. 5,929,022).

Other ingredients that can be included in a liquid laundry detergent include perfumes, which optionally contain ingredients such as aldehydes, ketones, esters, and alcohols. More compositions that can be included are: carriers, hydrotropes, processing aids, dyes, pigments, solvents, bleaches, bleach activators, fluorescent optical brighteners, and enzyme stabilizing packaging systems.

The co-surfactants and fatty acids described in U.S. Pat. No. 4,561,998, the teachings of which are incorporated herein by reference, can be included in the detergent compositions. In conjunction with anionic surfactants, these improve laundering performance. Examples include chloride, bromide and methylsulfate $C_8$-$C_{16}$ alkyl trimethylammonium salts, $C_8$-$C_{16}$ alkyl di(hydroxyethyl) methylammonium salts, $C_8$-$C_{16}$ alkyl hydroxyethyldimethylammonium salts, and $C_8$-$C_{16}$ alkyloxypropyl trimethylammonium salts.

Similar to what is taught in U.S. Pat. No. 4,561,998, the compositions herein can also contain from about 0.25% to about 12%, preferably from about 0.5% to about 8%, more preferably from about 1% to about 4%, by weight of a cosurfactant selected from the group of certain quaternary ammonium, diquaternary ammonium, amine, diamine, amine oxide and di(amine oxide) surfactants. The quaternary ammonium surfactants are particularly preferred.

Quaternary ammonium surfactants can have the following formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl, ring structures formed by joining the two $R^4$ groups, —$CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_8$-$C_{16}$ alkyl trimethylammonium salts, $C_8$-$C_{16}$ alkyl di(hydroxyethyl) methylammonium salts, $C_8$-$C_{16}$ alkyl hydroxyethyldimethylammonium salts, and $C_8$-$C_{16}$ alkyloxypropyl trimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

U.S. Pat. No. 4,561,998 also provides that under cold water washing conditions, in this case less than about 65° F. (18.3° C.), the $C_8$-$C_{10}$ alkyltrimethyl ammonium surfactants are particularly preferred since they have a lower Kraft boundary and, therefore, a lower crystallization temperature than the longer alkyl chain quaternary ammonium surfactants herein.

Diquaternary ammonium surfactants can be of the formula:

$$[R^2(OR^3)_y][R^4OR^3]_y]_2N^{30}\ R^3N^{30}\ R^5[R^4(OR^3)_y]_2\ (X^-)_2$$

wherein the $R^2$, $R^3$, $R^4$, $R^5$, y and X substituents are as defined above for the quaternary ammonium surfactants. These substituents are also preferably selected to provide diquaternary ammonium surfactants corresponding to the preferred quaternary ammonium surfactants. Particularly preferred are the $C_{8-16}$ alkyl pentamethyl-ethylenediammonium chloride, bromide and methylsulfate salts.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Diamine surfactants herein are of the formula $$[R^2(OR^3)_y][R^4(OR^3)_y]NR^3NR^5[R^4(OR^3)_y]$$

wherein the $R^2$, $R^3$, $R^4$, $R^5$ and y substituents are as defined above. Preferred are the $C_{12}$-$C_{16}$ alkyl trimethylethylene diamines.

Amine oxide surfactants useful herein are of the formula:

$$[R^2(OR^3)_y][R^4(OR^3)_y]R^5N\rightarrow O$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Di(amine oxide) surfactants herein are of the formula:

$$[R^2(OR^3)_y][R^4(OR^3)_y]\underset{\underset{O}{\downarrow}}{N}R^3\underset{\underset{O}{\downarrow}}{N}R^5[R^4(OR^3)_y]$$

wherein the $R^2$, $R^3$, $R^4$, $R^5$ and y substituents are as defined above, preferably is $C_{12-16}$ alkyl trimethylethylene di(amine oxide).

Other common cleaning adjuncts are identified in U.S. Pat. No. 7,326,675 and PCT Int. Publ. WO 99/05242. Such cleaning adjuncts are identified as including bleaches, bleach activators, suds boosters, dispersant polymers (e.g., from BASF Corp. or Dow Chemical) other than those described above, color speckles, silvercare, anti-tarnish and/or anti-corrosion agents, pigments, dyes, fillers, germicides, hydrotropes, anti-oxidants, enzyme stabilizing agents, properfumes, carriers, processing aids, solvents, dye transfer inhibiting agents, brighteners, structure elasticizing agents, fabric softeners, anti-abrasion agents, and other fabric care agents, surface and skin care agents. Suitable examples of such other cleaning adjuncts and levels of use are found in U.S. Pat. Nos. 5,576,282, 6,306,812, 6,326,348 and PCT Int. Publ. WO99/05242, the teachings of which are incorporated herein by reference.

Fatty Acids

Similar to that disclosed in U.S. Pat. No. 4,561,998, the detergent compositions may contain a fatty acid containing from about 10 to about 22 carbon atoms. The fatty acid can also contain from about 1 to about 10 ethylene oxide units in the hydrocarbon chain. Suitable fatty acids are saturated and/or unsaturated and can be obtained from natural sources such as plant or animal esters (e.g., palm kernel oil, palm oil, coconut oil, babassu oil, safflower oil, tall oil, castor oil, tallow and fish oils, grease, and mixtures thereof) or synthetically prepared (e.g., via the oxidation of petroleum or by hydrogenation of carbon monoxide via the Fisher-Tropsch process). Examples of suitable saturated fatty acids for use in the detergent compositions include capric, lauric, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{10}$-$C_{14}$ (coconut) fatty acids, from about 5:1 to about 1:1 (preferably about 3:1) weight ratio mixtures of lauric and myristic acid, and mixtures of the above lauric/myristic blends with oleic acid at a weight ratio of about 4:1 to about 1:4 mixed lauric/myristic:oleic.

U.S. Pat. No. 4,507,219 identifies various sulfonate surfactants as suitable for use with the above-identified co-surfactants. The disclosures of U.S. Pat. Nos. 4,561,998 and 4,507,219 with respect to co-surfactants are incorporated herein by reference.

Softergents

Softergent technologies as described in, for example, U.S. Pat. Nos. 6,949,498, 5,466,394 and 5,622,925 can be used in the detergent compositions. "Softergent" refers to a softening detergent that can be dosed at the beginning of a wash cycle for the purpose of simultaneously cleaning and softening fabrics. The mid-chain headgroup or alkylene-bridged surfactants can be used to make stable, aqueous heavy duty liquid laundry detergent compositions containing a fabric-softening agent that provide exceptional cleaning as well as fabric softening and anti-static benefits.

Some suitable softergent compositions contain about 0.5% to about 10%, preferably from about 2% to about 7%, more preferably from about 3% to about 5% by weight of a quaternary ammonium fabric-softening agent having the formula:

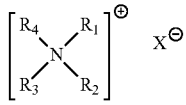

wherein $R_1$ and $R_2$ are individually selected from the group consisting of $C_1$-$C_4$ alkyl, $C_1$-$C_4$ hydroxy alkyl, benzyl, and —$(C_2H_4O)_x$ H where x has a value from 2 to 5; X is an anion; and (1) $R_3$ and $R_4$ are each a $C_8$-$C_{14}$ alkyl or (2) $R_3$ is a $C_8$-$C_{22}$ alkyl and $R_4$ is selected from the group consisting of $C_1$-$C_{10}$ alkyl, C-$C_{10}$ hydroxy alkyl, benzyl, and —$(C_2\ H_4O)_x$ H where x has a value from 2 to 5.

Preferred fabric-softening agents are the mono-long chain alkyl quaternary ammonium surfactants wherein in the above formula $R_1$, $R_2$, and $R_3$ are each methyl and $R_4$ is a $C_8$-$C_{18}$ alkyl. The most preferred quaternary ammonium surfactants are the chloride, bromide and methylsulfate $C_8$-$C_{16}$ alkyl trimethyl ammonium salts, and $C_8$-$C_{16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred.

Another class of preferred quaternary ammonium surfactants are the di-$C_8$-$C_{14}$ alkyl dimethyl ammonium chloride or methylsulfates; particularly preferred is di-$C_{12}$-$C_{14}$ alkyl dimethyl ammonium chloride. This class of materials is particularly suited to providing antistatic benefits to fabrics.

A preferred softergent comprises the detergent composition wherein the weight ratio of anionic surfactant component to quaternary ammonium softening agent is from about 3:1 to about 40:1; a more preferred range is from about 5:1 to 20:1.

Odor Control

Odor control technologies as described in, for example, U.S. Pat. No. 6,878,695 can be used in the detergent compositions.

For example, a composition containing one or more of the mid-chain headgroup or alkylene-bridged surfactants can further comprise a low-degree of substitution cyclodextrin derivative and a perfume material. The cyclodextrin is preferably functionally-available cyclodextrin. The compositions can further comprise optional cyclodextrin-compatible and -incompatible materials, and other optional components. Such a composition can be used for capturing unwanted molecules in a variety of contexts, preferably to control malodors including controlling malodorous molecules on inanimate surfaces, such as fabrics, including carpets, and hard surfaces including countertops, dishes, floors, garbage cans, ceilings, walls, carpet padding, air filters, and the like, and animate surfaces, such as skin and hair.

The low-degree of substitution cyclodextrin derivatives useful herein are preferably selected from low-degree of substitution hydroxyalkyl cyclodextrin, low-degree of substitution alkylated cyclodextrin, and mixtures thereof. Preferred low-degree of substitution hydroxyalkyl beta-cyclodextrins have an average degree of substitution of less than about 5.0, more preferably less than about 4.5, and still more preferably less than about 4.0. Preferred low-degree of substitution alkylated cyclodextrins have an average degree of substitution of less than about 6.0, more preferably less than about 5.5, and still more preferably less than about 5.0.

The detergent compositions can comprise a mixture of cyclodextrins and derivatives thereof such that the mixture effectively has an average degree of substitution equivalent to the low-degree of substitution cyclodextrin derivatives described hereinbefore. Such cyclodextrin mixtures preferably comprise high-degree of substitution cyclodextrin derivatives (having a higher average degree of substitution than the low-degree substitution cyclodextrin derivatives described herein) and non-derivatized cyclodextrin, such that the cyclodextrin mixture effectively has an average degree of substitution equivalent to the low-degree of substitution cyclodextrin derivative. For example, a composition comprising a cyclodextrin mixture containing about 0.1% non-derivatized beta-cyclodextrin and about 0.4% hydroxypropyl beta-cyclodextrin having an average degree of substitution of about 5.5, exhibits an ability to capture unwanted molecules similar to that of a similar composition comprising low-degree of substitution hydroxypropyl beta-cyclodextrin having an average degree of substitution of about 3.3. Such cyclodextrin mixtures can typically absorb odors more broadly by complexing with a wider range of unwanted molecules, especially malodorous molecules, having a wider range of molecular sizes preferably at least a portion of a cyclodextrin mixture is alpha-cyclodextrin and its derivatives thereof, gamma-cyclodextrin and its derivatives thereof, and/or beta-cyclodextrin and its derivatives thereof; more preferably a mixture of alpha-cyclodextrin, or an alpha-cyclodextrin derivative, and derivatized beta-cyclodextrin, even more preferably a mixture of derivatised alpha-cyclodextrin and derivatized beta-cyclodextrin; and most preferably a mixture of hydroxypropyl alpha-cyclodextrin and hydroxypropyl beta-cyclodextrin, and/or a mixture of methylated alpha-cyclodextrin and methylated beta-cyclodextrin.

The cavities within the functionally-available cyclodextrin in the detergent compositions should remain essentially unfilled (i.e., the cyclodextrin remains uncomplexed and free) or filled with only weakly complexing materials when in solution, in order to allow the cyclodextrin to absorb (i.e., complex with) various unwanted molecules, such as malodor molecules, when the composition is applied to a surface containing the unwanted molecules. Non-derivatized (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatized beta-cyclodextrin is generally not preferred when the composition contains surfactant since it affects the surface activity of most of the preferred surfactants that are compatible with the derivatized cyclodextrins.

The level of low-degree of substitution cyclodextrin derivatives that are functionally-available in the odor control compositions is typically at least about 0.001%, preferably at least about 0.01%, and more preferably at least about 0.1%, by weight of the detergent composition. The total level of cyclodextrin in the present composition will be at least equal to or greater than the level of functionally-available cyclodextrin. The level of functionally-available will typically be at least about 10%, preferably at least about 20%, and more preferably at least about 30%, by weight of the total level of cyclodextrin in the composition.

Concentrated compositions can also be used. When a concentrated product is used, i.e., when the total level of cyclodextrin used is from about 3% to about 60%, more preferably from about 5% to about 40%, by weight of the concentrated composition, it is preferable to dilute the concentrated composition before treating fabrics in order to avoid staining. Preferably, the concentrated cyclodextrin composition is diluted with about 50% to about 6000%, more preferably with about 75% to about 2000%, most preferably with about 100% to about 1000% by weight of the concentrated composition of water. The resulting diluted compositions have usage concentrations of total cyclodextrin and functionally-available cyclodextrin as discussed hereinbefore, e.g., of from about 0.1% to about 5%, by weight of the diluted composition of total cyclodextrin and usage concentrations of functionally-available cyclodextrin of at least about 0.001%, by weight of the diluted composition.

Forms

The detergent compositions can take any of a number of forms and any type of delivery system, such as ready-to-use, dilutable, wipes, or the like.

For example, the detergent compositions can be a dilutable fabric detergent, which may be an isotropic liquid, a surfactant-structured liquid, a granular, spray-dried or dry-blended powder, a tablet, a paste, a molded solid, a water soluble sheet, or any other laundry detergent form known to those skilled in the art. A "dilutable" fabric detergent composition is defined, for the purposes of this disclosure, as a product intended to be used by being diluted with water or a non-aqueous solvent by a ratio of more than 100:1, to produce a liquor suitable for treating textiles. "Green concentrate" compositions like those on the market today for Fantastic®, Windex® and the like, can be formulated such that they could be a concentrate to be added to a bottle for final reconstitution.

The detergent compositions can also be formulated as a gel or a gel packet or pod like the dishwasher products on the market today. Water-soluble sheets, sachets, or pods such as those described in U.S. Pat. Appl. No. 2002/0187909, the teachings of which are incorporated herein by reference, are also envisaged as a suitable form. The detergent composition can also be deposited on a wiper or other substrate.

Polymeric Suds Enhancers

In some aspects, polymeric suds enhancers such as those described in U.S. Pat. No. 6,903,064 can be used in the detergent compositions. For example, the compositions may further comprise an effective amount of polymeric suds volume and suds duration enhancers. These polymeric materials provide enhanced suds volume and suds duration during cleaning.

Examples of polymeric suds stabilizers suitable for use in the compositions:

(i) a polymer comprising at least one monomeric unit having the formula:

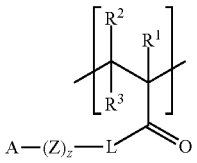

wherein each of $R^1$, $R^2$ and $R^3$ are independently selected from the group consisting of hydrogen, $C_1$ to $C_6$ alkyl, and mixtures thereof; L is O; Z is $CH_2$; z is an integer selected from about 2 to about 12; A is $NR^4R^5$, wherein each of $R^4$ and $R^5$ is independently selected from the group consisting of hydrogen, $C_1$ to $C_8$ alkyl, and mixtures thereof, or $NR^4R^5$ form an heterocyclic ring containing from 4 to 7 carbon atoms, optionally containing additional hetero atoms, optionally fused to a benzene ring, and optionally substituted by $C_1$ to $C_8$ hydrocarbyl;

(ii) a proteinaceous suds stabilizer having an isoelectric point from about 7 to about 11.5;

(iii) a zwitterionic polymeric suds stabilizer; or (iv) mixtures thereof.

Preferably, the exemplary polymeric suds stabilizer described above has a molecular weight of from about 1,000 to about 2,000,000; more preferably the molecular weight is about 5,000 to about 1,000,000.

Methods of Laundering Fabrics

Methods for laundering fabrics with mid-chain headgroup or alkylene-bridged surfactant-based formulations are contemplated. Such methods involve placing fabric articles to be laundered in a high efficiency washing machine or a regular (non-high efficiency) washing machine and placing an amount of the detergent composition sufficient to provide a concentration of the composition in water of from about 0.001% to about 5% by weight when the machine is operated in a wash cycle. A high efficiency machine is defined by the Soap and Detergent Association as any machine that uses 20% to 66% of the water, and as little as 20%-50% of the energy, of a traditional, regular agitator washer (SDA "Washers and Detergents" publication 2005; see www.cleaning101.com). The wash cycle is actuated or started to launder the fabric articles. Hand washing using the inventive detergent compositions is also contemplated. In particular, the detergents are beneficial for hand laundering and cold-water laundering of fine and delicate fabrics.

Thus, in one aspect, the invention is a method which comprises laundering one or more textile articles in water having a temperature less than 30° C., preferably from 5° C. to 30° C., the presence of an inventive detergent as described herein.

Other Applications

Although the mid-chain headgroup or alkylene-bridged surfactants have considerable value for laundry detergents, other end uses should benefit from their use. Thus, the surfactants should also be valuable in applications where greasy substances require removal or cleaning. Such applications include, for example, household cleaners, degreasers, sanitizers and disinfectants, light-duty liquid detergents, hard and soft surface cleaners for household, autodish detergents, rinse aids, laundry additives, carpet cleaners, spot treatments, softergents, industrial and institutional cleaners and degreasers, oven cleaners, car washes, transportation cleaners, drain cleaners, industrial cleaners, foamers, defoamers, institutional cleaners, janitorial cleaners, glass cleaners, graffiti removers, adhesive removers, concrete cleaners, metal/machine parts cleaners, and food service cleaners, and other similar applications for which removal of greasy soils is advantageously accomplished, particularly at room temperature or below. The detergents may also be beneficial for certain personal care applications such as hand soaps and liquid cleansers, shampoos, and other hair/scalp cleansing products, especially for oily/greasy hair, scalp, and skin, which are also beneficial when effective with lukewarm or cold water.

The following examples merely illustrate the invention; those skilled in the art will recognize many variations that are within the spirit of the invention and scope of the claims.

Preparation of Sodium 2-hexyl-1-decyl Sulfate

2-Hexyl-1-decanol (100.3 g) is added to a 1-L flask equipped with mechanical stirrer, nitrogen inlet, and reflux condenser. 1,4-Dioxane (500 mL) is added, and the mixture is stirred. Sulfamic acid (42.7 g) and urea (10.2 g) are added. The mixture is slowly heated to reflux (105° C.) and refluxing continues for 7 h. The mixture is cooled. Urea and residual sulfamic acid are removed by filtration. The mixture is concentrated to remove 1,4-dioxane. Methanol is added to the 2-hexyl-1-decyl sulfate ammonium salt, and then 50% aq. NaOH solution is added to achieve a pH of about 10.4. Methanol is removed. $^1$H NMR analysis shows significant impurities. The product is purified using a separatory funnel and 50:50 EtOH:deionized water with petroleum ether as extractant. The resulting mixture, which contains sodium 2-hexyl-1-decyl sulfate, is stripped and analyzed (96.9% actives by $^1$H NMR).

Preparation of 9-octadecanol

A 1-L flask containing magnesium turnings (13.3 g) is flame dried. A reflux condenser and an addition funnel, each fitted with a drying tube, are attached. A mechanical stirrer is also used, and all glassware is flame dried. Anhydrous tetrahydrofuran (THF, 100 mL) is added to the magnesium turnings. The addition funnel is charged with 1-bromononane (100.0 g) and dry THF (50 mL). The 1-bromononane solution is slowly added to the magnesium, and the reaction starts immediately. 1-Bromononane is added at a rate to keep the THF at reflux. After completing the alkyl halide addition, the reaction mixture stirs for an additional 30 min. Another addition funnel is charged with nonanal (68.7 g) and dry THF (50 mL). The nonanal solution is added as rapidly as possible while keeping the temperature at about 60° C. After completing the aldehyde addition, the reaction mixture stirs for an additional 30 min. at 60° C. After cooling, a stoichiometric amount of hydrochloric acid (25 wt. % aq. HCl) is added. Deionized water (50 mL) is added, and the THF layer is isolated and concentrated. 9-Octadecanol is purified using a column with neutral Brockman I alumina using 1:1 hexane:diethyl ether as an eluent. $^1$H NMR analysis shows about 92% pure 9-octadecanol.

Preparation of Sodium 9-octadecyl Sulfate

9-Octadecanol (64.9 g, 0.24 mol) is added to a 1-L flask equipped with mechanical stirrer, nitrogen inlet, and reflux condenser. 1,4-Dioxane (300 mL) is added, and the mixture is stirred. Sulfamic acid (24.4 g, 0.25 mol) and urea (5.0 g) are added. The mixture is slowly heated to reflux (105° C.) and refluxing continues for 14 h. $^1$H NMR shows that the reaction is nearly complete. The mixture is cooled. Urea and residual sulfamic acid are removed by filtration. The mixture is concentrated to remove 1,4-dioxane. Methanol is added to the 9-octadecyl sulfate ammonium salt, and then 50% aq. NaOH solution is added to achieve a pH of about 10.6. Methanol is removed. $^1$H NMR analysis shows significant impurities. The product is purified using a column with Brockman I neutral alumina and 50:50 MeOH:deionized water as the eluent. The resulting mixture, which contains sodium 9-octadecyl sulfate, is stripped and analyzed (82.1% solids at 105° C., 99.3% actives by $^1$H NMR).

Procedure for Testing Laundry Detergent Samples

Laundry detergent (to give 0.1% actives in washing solution) is charged to the washing machine, followed by soiled/stained fabric swatches that are attached to pillowcases. Wash temperature: 60° F. Rinse temperature: 60° F. The swatches are detached from pillowcases, dried, and ironed. Swatches are scanned to measure the L* a* b* values, which are used to calculate a stain removal index (SRI) for each type of swatch. Finally, the ΔSRI is calculated, which equals the experimental sample SRI minus the SRI of a pre-determined standard laundry detergent formula (or control). When $|\Delta SRI| \geq 0.5$ differences are perceivable to the naked eye. If the value of ΔSRI is greater than or equal to 0.5, the sample is superior. If ΔSRI is less than or equal to −0.5, the sample is inferior. If ΔSRI is greater than −0.5 and less than 0.5, the sample is considered equal to the standard.

The following standard soiled/stained fabric swatches are used: bacon grease, butter, cooked beef fat, and beef tallow on cotton fabric. At least three swatches of each kind are used per wash. Swatches are stapled to pillowcases for laundering, and extra pillowcases are included to complete a six-pound fabric load.

The same procedure is used to launder all of the pillowcases/swatches, with care taken to ensure that water temperature, wash time, manner of addition, etc. are held constant for the cold-water wash process. When the cycle is complete, swatches are removed from the pillowcases, dried at low heat on a rack, and pressed gently and briefly with a dry iron.

A Hunter LabScan® XE spectrophotometer is used to determine the L* a* b* values to calculate the SRI for every type of swatch, and the stain removal index (SRI) is calculated as follows:

$$SRI = 100 - \sqrt{(L^*_{clean} - L^*_{washed})^2 + (a^*_{clean} - a^*_{washed})^2 + (b^*_{clean} - b^*_{washed})^2}$$

$$\Delta SRI = SRI_{sample} - SRI_{standard}$$

Table 1 provides formulation details. The Control formulation (without lipase) and Formulation A (with lipase) include Biosoft® S-101 (product of Stepan, linear alkylbenzene sulfonic acid neutralized in-situ with NaOH (50%), q.s. to pH of 8.4, to make the corresponding sodium salt, "NaLAS"), Neodol® 25-7 (product of Shell Chemicals, a fatty alcohol ethoxylate), and a sodium $C_{12}$-$C_{14}$ alcohol ethoxylate (3 EO) sulfate ("NaAES (3 EO)"). "Control" and Formulations B and D are all comparative formulations because none includes both lipase and either a mid-chain headgroup surfactant or an alkylene-bridged surfactant.

Formulation B includes the NaLAS, NaAES, and Neodol® 25-7 surfactants and also includes sodium 2-hexyl-1-decyl sulfate, an alkylene-bridged surfactant. Formulation B does not include lipase and is intended as a comparative example.

Formulation C is Formulation B plus lipase and shows a positive effect on detergency by combining an alkylene-bridged surfactant with a lipase.

Formulation D includes the NaLAS, NaAES, and Neodol® 25-7 surfactants and also includes sodium 9-octadecyl sulfate, a mid-chain headgroup surfactant. Formulation D does not include lipase and is intended as a comparative example.

Formulation E is Formulation D plus lipase and shows a positive effect on detergency by combining a mid-chain headgroup surfactant with a lipase.

Table 2 summarizes the performance results for cold-water cleaning of cotton fabric treated with bacon grease, butter, cooked beef fat, and beef tallow greasy soils. All formulations are tested at 0.1% actives levels. Wash cycles are 30 min in front-loading high-efficiency washing machines. The target performance (which corresponds to a ΔSRI value of 0.0 for Control and 1.5 for Formulation A) is that of a control cold-water detergent used with a cold-water wash (60° F.) and cold-water rinse (60° F.).

As Table 2 shows, the combination of a lipase with either a mid-chain headgroup surfactant (e.g., sodium 9-octadecyl sulfate) or an alkylene-bridged surfactant (e.g., sodium 2-hexyl-1-decyl sulfate) gives a remarkable improvement in cleaning greasy soils such as bacon grease, beef tallow, or cooked beef fat compared with the same formulation without the lipase. The overall change in ΔSRI (i.e., ΔΔSRI) when including lipase (Formulation C vs. Formulation B or Formulation E vs. Formulation D) is substantial when the mid-chain headgroup surfactant or alkylene-bridged surfactant is present, i.e, synergy is evident between the lipase and the mid-chain headgroup or alkylene-bridged surfactant. In contrast, merely including a lipase in the usual formulation with NaLAS, NaAES, and fatty alcohol ethoxylate surfactants (as in Formulation A vs. Control) provides only a marginal overall improvement in stain removal index.

TABLE 1

Cold-Water Liquid Laundry Detergent Formulations

| | Formulations | | | | | |
|---|---|---|---|---|---|---|
| | Control wt. % active | A wt. % active | B wt. % active | C wt. % active | D wt. % active | E wt. % active |
| Sodium citrate dihydrate | 3.5 | 3.5 | 3.5 | 3.5 | 3.5 | 3.5 |
| Bio-Soft ® S-101 (96.85%) HLAS | 7.9 | 7.9 | 6.4 | 6.4 | 7.4 | 7.4 |
| Monoethanolamine, 99% | 1.75 | 1.75 | 1.75 | 1.75 | 1.75 | 1.75 |
| Neodol ® 25-7, 100% | 11.9 | 11.9 | 11.9 | 11.9 | 11.9 | 11.9 |
| Stepanate ® SCS (44.9%) (Na cumene sulfonate) | 1.115 | 1.115 | 1.1125 | 1.1125 | 1.1125 | 1.1125 |
| Coco fatty acid, Vdistill ™ 7901, 100% | 2.95 | 2.95 | 2.95 | 2.95 | 2.95 | 2.95 |
| Borax $5H_2O$, 100% | 2.0 | 2.0 | 2.0 | 2.0 | 2.0 | 2.0 |
| Propylene glycol, 100% | 3.75 | 3.75 | 3.75 | 3.75 | 3.75 | 3.75 |
| Calcium chloride dihydrate, 100% | 0.1 | 0.1 | 0.1 | 0.1 | 0.1 | 0.1 |
| Lipolase ® 100L (lipase), 100% | — | 0.5 | — | 0.5 | — | 0.5 |
| Sodium $C_{12}$-$C_{14}$ alcohol ethoxylate (3 EO) sulfate (27.66%), NaAES (3EO) | 7.74 | 7.74 | 6.24 | 6.24 | 7.24 | 7.24 |
| Sodium 2-hexyl-1-decyl sulfate (95.2%) | — | — | 3.0 | 3.0 | — | — |
| Sodium 9-octadecyl sulfate (98.28%) | — | — | — | — | 1.0 | 1.0 |
| Deionized water | q.s. to 100% | q.s. to 100% | q.s. to 100% | q.s. to 100% | q.s. to 100% | q.s. to 100% |
| NaOH (50%), pH adjustment* | q.s. | q.s. | q.s. | q.s. | q.s. | q.s. |
| adjusted pH | 8.4 | 8.4 | 8.4 | 8.4 | 8.4 | 8.4 |

*NaOH q.s. is used for neutralization of coco fatty acid and linear alkylbenzene sulfonic acid (Bio-Soft ® S-101) to form the corresponding sodium salt, and also to obtain final pH = 8.4 of the final formulation.
Vdistill ™ 7901 coco fatty acid is a product of Vantage Oleochemicals.

TABLE 2

Performance in Cold-Water Cleaning Greasy Soil Stain Set

| | ΔSRI of Cleaning Data at 60° F. wash/60° F. rinse | | | | | |
|---|---|---|---|---|---|---|
| | Detergency for Individual Soils (ΔSRI) | | | | Total Detergency (ΔSRI) for Four Soils | Difference in Overall Detergency ΔΔSRI = (ΔSRI formulations with lipase − ΔSRI formulations without lipase) |
| Test formulation (0.1% actives) | Bacon Grease | Butter | Beef Tallow | Cooked Beef Fat | Overall ΔSRI | ΔΔSRI |
| NaLAS/Na AES (3 EO)/ Neodol ® 25-7 without lipase (Control) | 0.00 | 0.00 | 0.00 | 0.00 | 0.00 | — |
| NaLAS/ Na AES (3 EO)/ Neodol ® 25-7 with lipase (Formulation A) | −0.30 | −0.36 | 3.14 | 0.01 | 2.49 | 2.49 |
| Sodium 2-hexyl-1-decyl sulfate (3%)/NaLAS/ Na AES (3 EO)/ Neodol ® 25-7 without lipase (Formulation B) | −0.27 | 0.01 | 4.64 | −0.73 | 3.65 | — |
| Sodium 2-hexyl-1-decyl sulfate (3%)/NaLAS/ Na AES (3 EO)/ Neodol ® 25-7 with lipase (Formulation C) | 0.35 | 0.20 | 9.98 | −0.33 | 10.20 | 6.55 |
| Sodium 9-octadecyl sulfate (1%)/NaLAS/ Na AES (3 EO)/ Neodol ® 25-7 without lipase (Formulation D) | 0.55 | 0.57 | 5.99 | 0.69 | 7.80 | — |
| Sodium 9-octadecyl sulfate (1%)/NaLAS/ Na AES (3 EO)/ Neodol ® 25-7 with lipase (Formulation E) | 1.65 | 0.66 | 8.14 | 2.14 | 12.59 | 4.79 |

The preceding examples are meant only as illustrations; the following claims define the scope of the inventive subject matter.

We claim:

1. A laundry detergent, useful for cold-water cleaning, comprising:

an alkylene-bridged surfactant selected from the group consisting of a 2-hexyl-1-decyl sulfate, a 2-octyl-1-decyl sulfate, a 2-hexyl-1-dodecyl sulfate, or a mixture thereof; and (b) a lipase.

2. The detergent of claim 1 further comprising an anionic surfactant selected from the group consisting of linear alkylbenzene sulfonates, fatty alcohol sulfates, fatty alcohol ether sulfates, and mixtures thereof.

3. The detergent of claim 1 further comprising water.

4. The detergent of claim 1 comprising 1 to 20 wt. % of the alkylene-bridged surfactant.

5. A liquid, powder, paste, granule, tablet, molded solid, water-soluble sheet, water-soluble sachet, or water-soluble pod comprising the detergent of claim 1.

6. The detergent of claim 1 comprising water, 1 to 20 wt. % of the alkylene-bridged surfactant, 5 to 15 wt. % of an anionic surfactant selected from the group consisting of linear alkylbenzene sulfonates, fatty alcohol sulfates, fatty alcohol ether sulfates, and mixtures thereof, and 5 to 15 wt. % of a fatty alcohol ethoxylate.

7. A method which comprises laundering a soiled textile article in water having a temperature less than 30° C. in the presence of the detergent of claim 1 to produce a cleaned textile article.

8. The method of claim 7 wherein the method provides a stain removal index improvement of at least 2.0 units at the same wash temperature on at least one greasy soil when compared with the stain removal index provided by a method using the same laundering procedures, and in which the detergent comprises the same alkylene-bridged surfactant but lacks the lipase.

9. The method of claim 7 wherein the detergent further comprises an anionic surfactant selected from the group consisting of linear alkylbenzene sulfonates, fatty alcohol sulfates, fatty alcohol ether sulfates, and mixtures thereof.

10. The method of claim 7 wherein the detergent further comprises water.

11. The method of claim 7 wherein the alkylene-bridged surfactant is a 2-hexyl-1-decyl sulfate.

12. The method of claim 7 wherein the detergent further comprises a fatty alcohol ethoxylate.

13. The method of claim 7 wherein the detergent comprises 1 to 20 wt. % of the alkylene-bridged surfactant.

14. The method of claim 7 wherein the detergent comprises 1 ppm to 1 wt. % of the lipase.

15. The method of claim 7 wherein the detergent comprises 10 ppm to 0.5 wt. % of the lipase.

16. The method of claim 7 wherein the detergent is used in the form of a liquid, powder, paste, granule, tablet, molded solid, water-soluble sheet, water-soluble sachet, or water-soluble pod.

* * * * *